US011156348B2

(12) United States Patent
Pinker, Jr.

(10) Patent No.: US 11,156,348 B2
(45) Date of Patent: Oct. 26, 2021

(54) PORTABLE HAZARDOUS LOCATION WORK LIGHT

(71) Applicant: K&H Industries, Inc., Hamburg, NY (US)

(72) Inventor: Joseph Pinker, Jr., Eden, NY (US)

(73) Assignee: K&H Industries, Inc., Hamburg, NY (US)

( * ) Notice: Subject to any disclaimer, the term of this patent is extended or adjusted under 35 U.S.C. 154(b) by 646 days.

(21) Appl. No.: 16/032,992

(22) Filed: Jul. 11, 2018

(65) Prior Publication Data

US 2020/0018471 A1 Jan. 16, 2020

(51) Int. Cl.
*F21V 25/12* (2006.01)
*F21L 14/02* (2006.01)
*F21V 23/00* (2015.01)

(52) U.S. Cl.
CPC ..... *F21V 25/12* (2013.01); *F21L 14/02* (2013.01); *F21V 23/002* (2013.01)

(58) Field of Classification Search
CPC .... F21V 29/507; F21V 15/01; F21V 23/0414; F21V 25/12
USPC ..... 362/157
See application file for complete search history.

(56) References Cited

U.S. PATENT DOCUMENTS 3,283,143 A * 11/1966 Gosnell ..... F21S 41/29 362/317
6,464,383 B1 * 10/2002 Northington ..... A61B 90/35 362/572
2008/0112157 A1 * 5/2008 Boothe ..... F21V 5/00 362/101
2009/0296402 A1 12/2009 Chang
2011/0194280 A1 8/2011 Ruffin, Jr. et al.
2013/0308306 A1 * 11/2013 Hootman ..... F21V 21/0816 362/184
2014/0211474 A1 * 7/2014 Juan ..... F21V 17/164 362/267
2014/0293592 A1 * 10/2014 Hopper ..... F21V 23/023 362/183

(Continued)

OTHER PUBLICATIONS

Ericson, "Hazardous Duty LED, Incandescent & Fluorescent Headlamps", at least as early as Jan. 23, 2018, 1 page.

(Continued)

*Primary Examiner* — William J Carter
(74) *Attorney, Agent, or Firm* — Walter W. Duft

(57) ABSTRACT

A hazardous location light source module includes a metal base carrier having a light-module support surface on its upper side and a mounting stem on its lower side. The light-module support surface supports a light-module substrate mounting one or more light-emitting devices. The mounting stem is configured for mounting the light source module to a modular hazardous location light source assembly. A wiring port extending through the mounting stem to the base carrier upper side receives electrical wiring that connects electrically to the light-emitting device(s). A main-lens support surface on the base carrier upper side supports a light-transmitting main lens that comprises chemically strengthened glass and has a maximum dimension to maximum thickness ratio of not less than approximately 40:1. The main lens is permanently secured to the base carrier by virtue of a base carrier periphery being deformed into a lip that folds over to capture the main lens.

22 Claims, 20 Drawing Sheets

(56) References Cited

U.S. PATENT DOCUMENTS

2016/0085022 A1* 3/2016 Yang ..... F21V 25/12
362/23.08

OTHER PUBLICATIONS

GLAMOX, "TX 65 LED", at least as early as Jan. 23, 2018, 3 pages.
Larson Electronics, LLC, "40 Watt Hazardous Locations Low Profile LED Light Fixture—Class 1 Div 2—ATEX Rated—120/277V AC", at least as early as Jan. 23, 2018, 9 pages.
RAB Lighting, "HASXLED26CF", at least as early as Jan. 23, 2018, 3 pages.
Stewart R. Browne Manufacturing Company, Inc., "Model XP2400-50P/Ws Hazardous Location Light on Wheel Stand", at least as early as Jan. 23, 2018, 1 page.
Western Technology, "The Brick", at least as early as Jan. 23, 2018, 2 pages.
Western Technology, "The Stringer Optional Configuration of the BRICKette", at least as early as Jan. 23, 2018, 1 page.
Solas Ray Lighting, "LED Hazardous Location Lighting Commercial & Industrial Lighting Equipment", at least as early as Jan. 23, 2018, 26 pages.
Solas Ray Lighting, "Specifications LED Hazloc Lighting, The Lookout", at least as early as Jan. 23, 2018, 2 pages.
Solas Ray Lighting, "Specifications LED Hazloc Lighting, The Monitor", at least as early as Jan. 23, 2018, 2 pages.

* cited by examiner

PORTABLE HAZARDOUS LOCATION WORK LIGHT

BACKGROUND

1. Field

The present disclosure relates to portable electric lighting equipment for use in hazardous locations. The disclosure particularly concerns portable hazardous location work lights.

2. Description of the Prior Art

By way of background, portable hazardous location lighting is intended for use in areas wherein the internal components of the lighting equipment must remain electrically and thermally isolated from the surrounding environment. Such locations are typically characterized by the presence of combustible, flammable or caustic materials. Examples include indoor or outdoor sites utilized for activities such as construction, manufacturing, processing, excavating, drilling, maintenance, storage, and loading, to name but a few.

Portable lighting equipment for hazardous locations must be designed to prevent the ignition of a potentially flammable atmosphere, the propagation of fire, and the triggering of explosions. Such equipment usually consists of a suitable light source, such as an array of LEDs (light-emitting diodes), housed within a portable enclosure assembly that includes a borosilicate glass lens through which the light is emitted. The enclosure assembly and glass lens are designed to act as a pressure vessel that can withstand an internal explosion that could ignite volatile components that may be present in the surrounding atmosphere. Being portable, such equipment must also withstand shock loads caused by impacts resulting from dropping or other rough handling.

The present disclosure is directed to improvements in portable hazardous location lighting equipment that overcome various disadvantages and deficiencies thereof.

SUMMARY

A hazardous location light source module designed for portable use is disclosed, together with related portable modular hazardous location light assemblies.

In an embodiment, the hazardous location light source module includes a metal base carrier having a base carrier upper side, a base carrier lower side and a base carrier periphery. A lighting-support surface is on the base carrier upper side. A light-emitting device board is on the lighting-support surface. The light-emitting device board mounts one or more light-emitting devices. A base-carrier mounting stem is on the base carrier lower side. The base-carrier mounting stem is configured for mounting the hazardous location light source module to a portable modular hazardous location light assembly. A wiring port extends through the base carrier mounting stem to the base carrier upper side. Electrical wiring feeds through the wiring port and is connected electrically to the one or more light-emitting devices. A main-lens support surface is on the base carrier upper side. A main light-transmitting lens is on the main-lens support surface. The main lens has a main lens lower side facing toward the light-emitting devices and a main lens upper side facing away from the light-emitting devices.

In one aspect of the light source module, the main lens includes chemically strengthened glass and has a ratio of maximum dimension to maximum thickness of not less than approximately 40:1. The main lens is permanently secured to the base carrier by virtue of the base carrier periphery being deformed into a main-lens retaining lip that folds over to capture the main lens on the main lens upper side.

In another aspect of the light source module, the module includes a light-transmitting protective lens disposed above the main lens in spaced relationship therewith. The protective lens includes an impact-resistant thermoplastic material.

In an embodiment, the portable modular hazardous location light assemblies include one or more of the hazardous location light source module, an enclosure, one or more mounting ports on the enclosure engaging the base-carrier mounting stem of the hazardous location light source module(s), and one or more power cord ports on the enclosure receiving one or more electrical power cords that connect electrically to the electrical wiring of the hazardous location light source module(s).

In an embodiment, a portable modular hazardous location light assembly is constructed as a single-head unit that carries one of the hazardous location light source modules.

In an embodiment, a portable modular hazardous location light assembly is constructed as a multi-head unit that carries multiple hazardous location light source modules.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
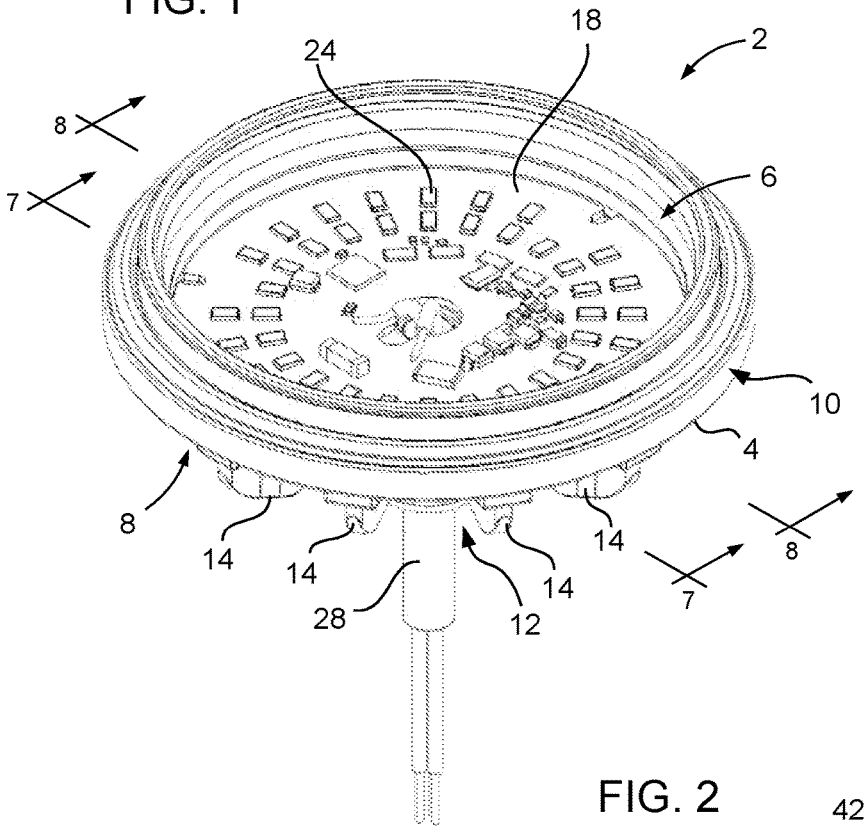
FIG. 1 is an upper perspective view of a portable hazardous location light source module constructed in accordance with an embodiment of the present disclosure.
Figure 2:
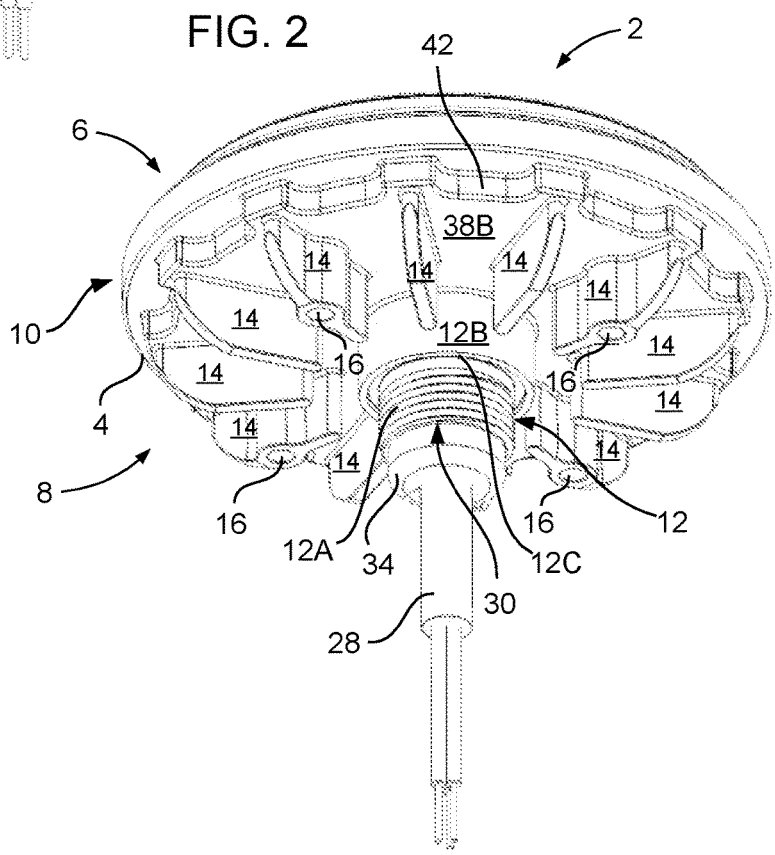
FIG. 2 is a lower perspective view of the light source module of FIG. 1.
Figure 3:
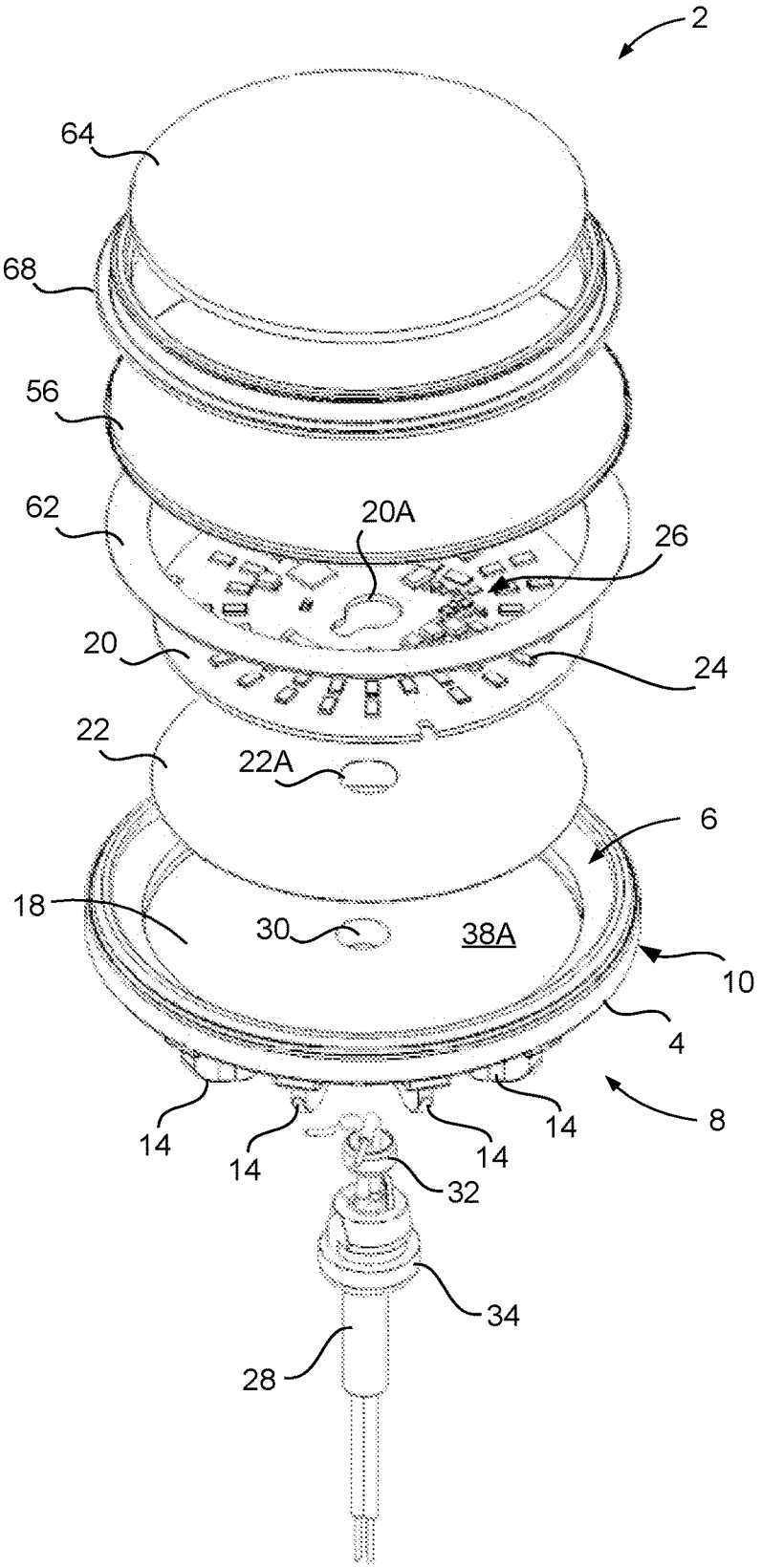
FIG. 3 is an exploded upper perspective view of the light source module of FIG. 1.

Turning now to the drawing figures, wherein like reference numbers are used to represent like elements in all of the several views, FIGS. 1-3 illustrate a hazardous location light source module 2 constructed in accordance with an embodiment of the present disclosure. The light source module 2 includes a metal base carrier 4 having a base carrier upper side 6, a base carrier lower side 8 and a ring-shaped base carrier periphery 10. The base carrier 4 may be formed from any suitable metal, with metals such as aluminum being advantageous due to their light weight and thermal conductivity. A low copper-content aluminum is particularly desirable in order to reduce the possibility of sparking. In the illustrated embodiment, the base carrier 4 is formed as a monolithic structure that may be formed by machining, die casting, or in any other suitable manner. Non-monolithic base carrier constructions could also be used, but have the disadvantage of requiring assembly of component parts.

Figure 4:
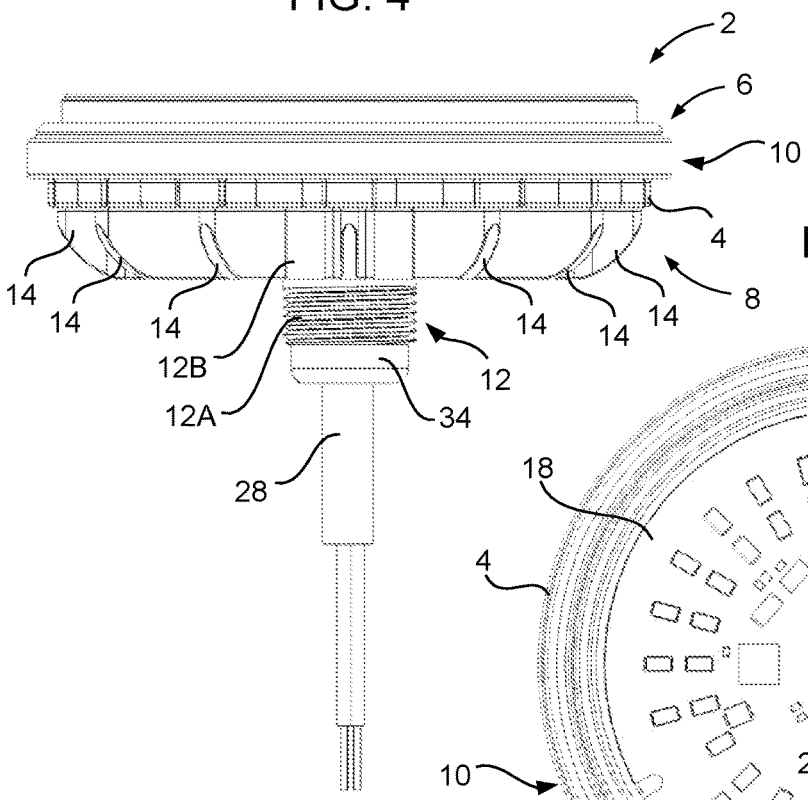
FIG. 4 is a side elevation view of the light source module of FIG. 1.
Figure 5:
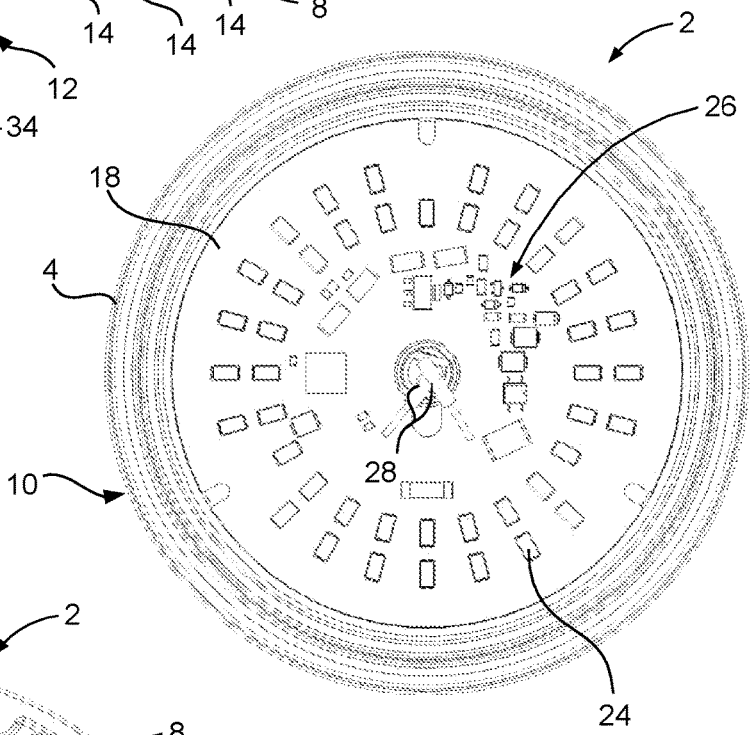
FIG. 5 is a top view of the light source module of FIG. 1.
Figure 6:
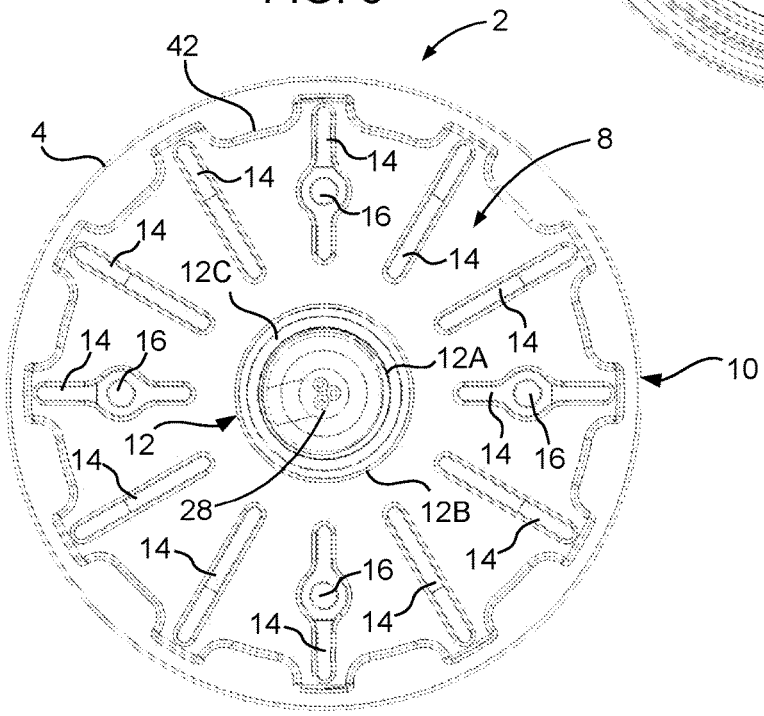
FIG. 6 is a bottom view of the light source module of FIG. 1.

As additionally shown in FIGS. 4-6, the base carrier 4 may be somewhat disk-shaped, with a substantially circular configuration when seen in plan view orientation (see FIG. 5). In a side view orientation (see FIG. 4), the base carrier 4 has a relatively flat profile apart from a mounting stem 12 formed (e.g., monolithically) as part of the base carrier 4 on the base carrier lower side 8. The relative flatness of the base carrier 4 is characterized in the illustrated embodiment by the base carrier's outside diameter being several times larger than its overall height (exclusive of the mounting stem 12), specifically about 4:1. It will be appreciated that alternative base carrier configurations may also be used, such as configurations are non-circular and/or with side profiles that are not relatively flat.

In the illustrated embodiment, the mounting stem 12 is substantially cylindrical in shape and aligned with the central axis of the base carrier 4. Off-axis mounting locations could also be used. As can be seen in FIGS. 2 and 4, the mounting stem 12 is externally threaded at 12A in order to facilitate convenient mounting of the light source module 2 as part of a portable modular hazardous location light assembly (not shown in FIGS. 1-6). This mounting is described in more detail in connection with the example light assembly embodiments shown in FIGS. 9-28. The external threads 12A are provided proximate to a free end of the mounting stem 12. A base end of the mounting stem 12 is non-threaded, and includes an enlarged diameter portion 12B. The enlarged diameter portion 12B facilitates the formation of an annular pocket 12C in which a suitable seal, such as a resilient O-ring compression seal (not shown in FIGS. 1-6) may be seated. See discussion of FIGS. 9-28 below.

In addition to the mounting stem 12, the base carrier lower side 8 may be formed with a set of heat fins 14 for dissipating heat away from the light source module electronics (see below). This is best shown in FIGS. 2, 4 and 6. In the circularly-configured base carrier 4 of the illustrated embodiment, the heat fins 14 may be conveniently arranged to extend in a radial direction, with other configurations also being possible. As described in more detail below in connection with FIG. 14, some of the heat fins (e.g., four) are configured with mounting holes 16 for receiving fasteners that assist in configuring a portable modular hazardous location light assembly that incorporates the light source module 2.

As best shown in FIG. 3, the base carrier 4 further includes a lighting-support surface 18 on the base carrier upper side 6. A light-emitting device board 20 is disposed on the lighting-support surface 18, and may be secured thereto by double-sided thermally-conductive adhesive element 22. The light-emitting device board 20 mounts one or more light-emitting devices 24, such as light-emitting diodes (LEDs). Power supply circuitry 26 may be provided to deliver direct current voltage to the light-emitting device(s) 24 from an alternating current utility mains source (not shown). The alternating current is delivered by electrical wiring 28 that feeds through a wiring port 30 in the base carrier 4. The electrical wiring 28 may be embodied as a conventional 3-wire electrical cord that includes hot, neutral and ground wires. Note that only two of the wires are shown in FIGS. 1-3 due to the third wire being hidden from view. In an alternative embodiment, the light-emitting device board 26 could be configured for low-voltage direct current operation.

The wiring port 30 extends through the base carrier mounting stem 12 to the base carrier upper side 6, where it forms an opening in the lighting-support surface 18. Openings 20A and 22A respectively formed in the light-emitting device board 20 and the adhesive element 22 allow the leads of the electrical wiring 28 to reach the power supply circuitry 26 on the upper side of the light-emitting device board. There, the electrical wiring connects electrically (via the power supply circuitry 26) to the light-emitting device(s) 24. In the illustrated embodiment wherein the electrical wiring 28 delivers utility mains power to the light emitting device board 20, there will typically be positive, negative and ground wires. As noted above, the light-emitting device board 26 could be configured for low-voltage direct current operation in an alternative embodiment.

Figure 8A:
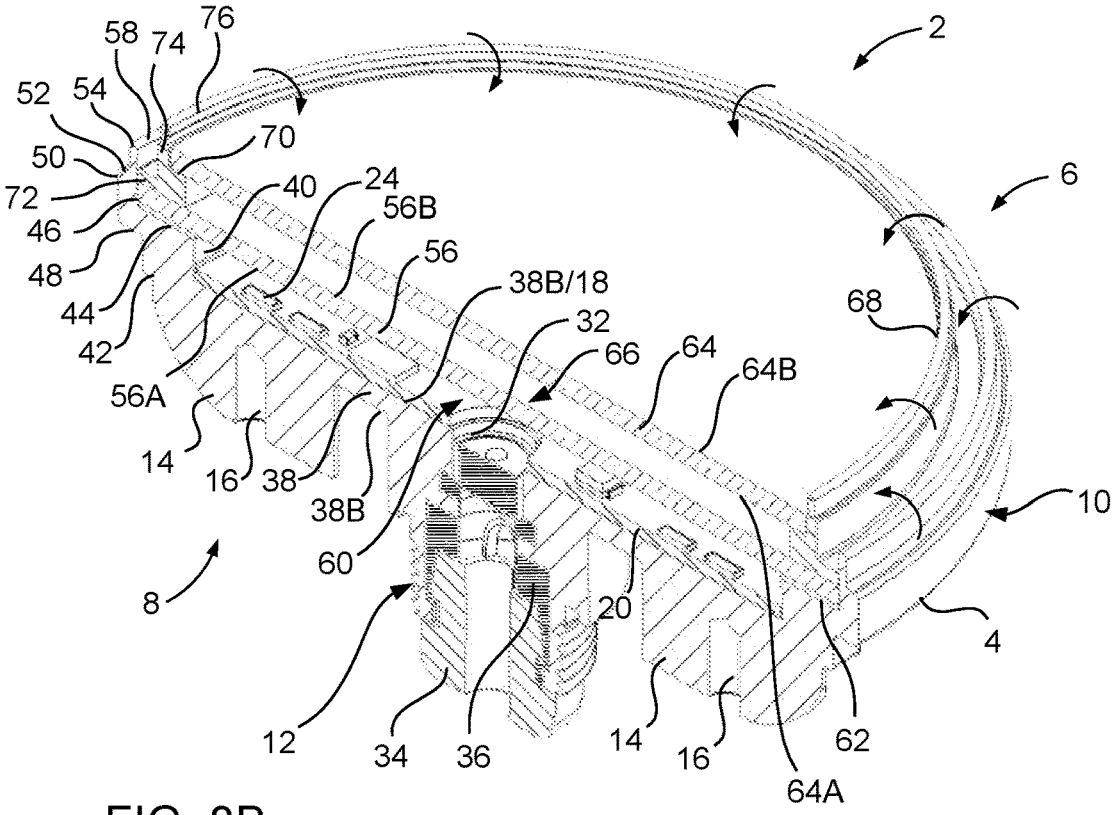
FIG. 8A is a cross-sectional centerline perspective view taken along line 8-8 in FIG. 1, prior to roll-forming operations that secure a main lens and a protective lens of the light source module of FIG. 1.
Figure 8B:
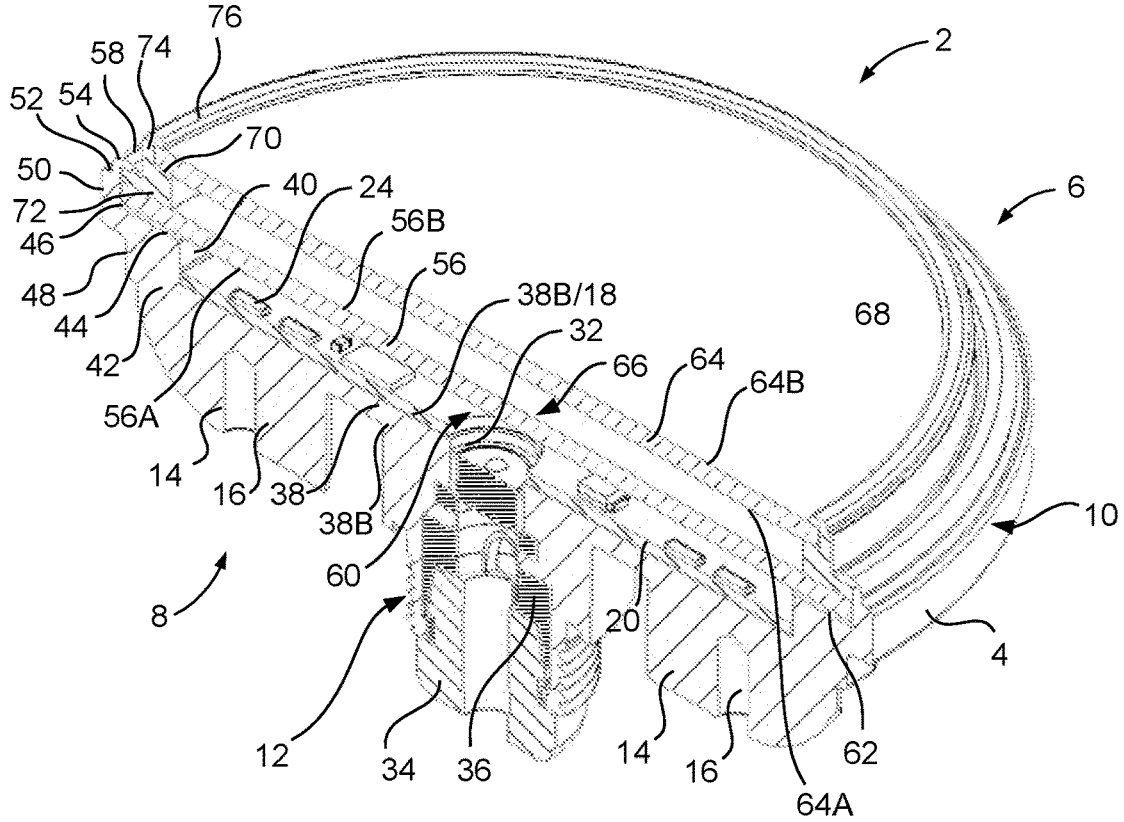
FIG. 8B is a cross-sectional centerline perspective view taken along line 8-8 in FIG. 1, subsequent to roll-forming operations that secure a main lens and a protective lens of the light source module of FIG. 1.

As shown near the bottom of FIG. 3, a metallic grounding ferrule 32 is pressed into the wiring port 30 so as to be in electrical contact with the metal base-carrier 4. A snap-in strain-relief cord retainer 34 inserts into the entry of the wiring port 30 at the free end of the mounting stem 12, and seats in the manner shown in FIG. 2. After the wiring 28 is connected to the light-emitting device board 20, but prior to insertion of the cord retainer 34, a quantity of epoxy (shown by reference number 36 in FIGS. 8A-8B) is introduced into the wiring port 30 to fill various open cavities therein. The epoxy seals wiring port 30 against any ingress of flammable materials and moisture that might otherwise come into contact with the light module electronics. As shown in FIGS. 8A-8B, the epoxy 36 may extend from the free end of the mounting stem 12 to the top of the grounding ferrule 30. FIGS. 8A-8B are discussed in more detail below.

Figure 7:
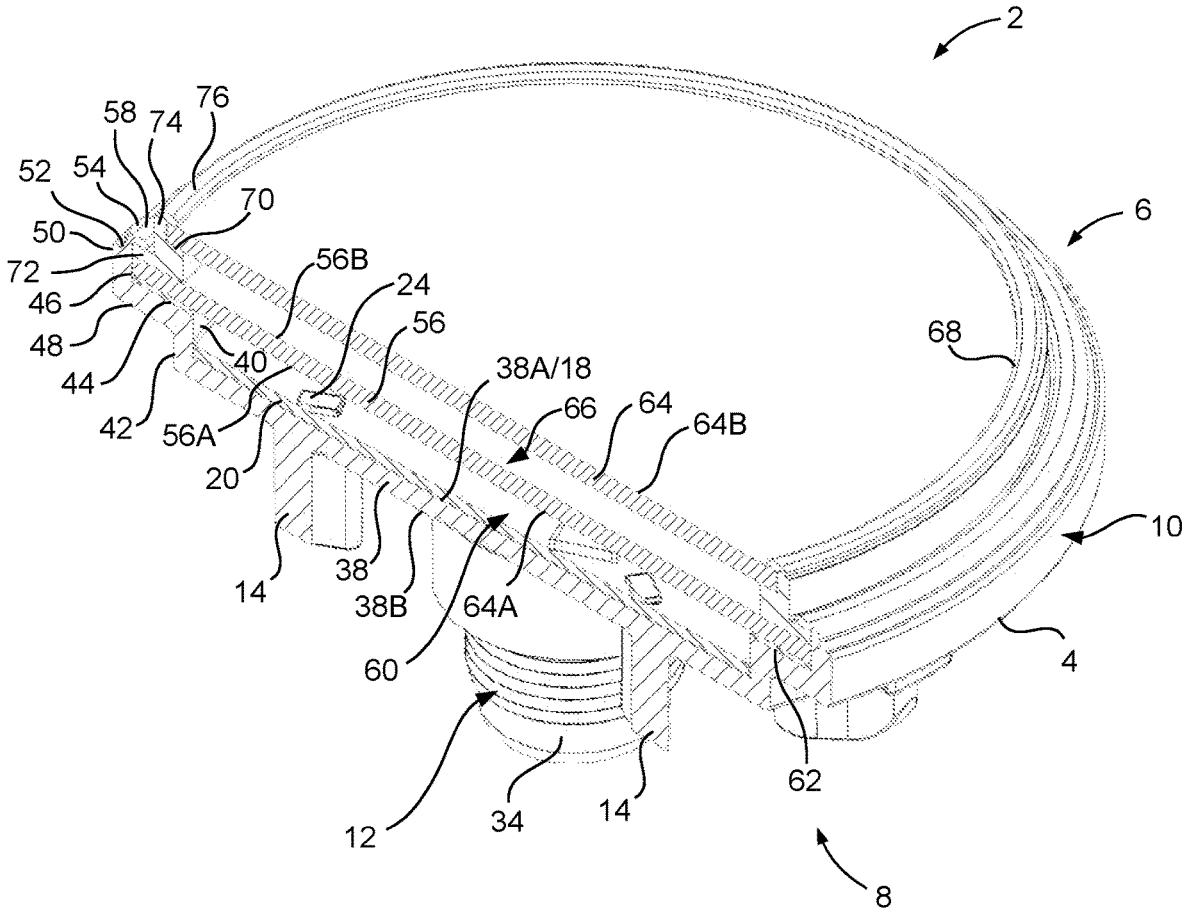
FIG. 7 is a cross-sectional off-center perspective view taken along line 7-7 in FIG. 1.

Turning now to FIG. 7, an off-center cross-sectional perspective view of the light source module 2 is shown. FIG. 7 illustrates additional details of the base carrier 4 according to the present embodiment. For example, the base carrier's upper and lower sides 6 and 8 are shown as being separated by a relatively thin base carrier plate member 38. The upper face 38A of the base carrier plate member 38, which is also shown in FIG. 3, provides the lighting-support surface 18. In the illustrated embodiment, the upper face 38A of the base carrier plate member 38 is substantially circular in shape, with the peripheral edge thereof being bounded by an upwardly-extending first inside wall 40 of the base carrier periphery 10, which is also circular. The lower face 38B of the base carrier plate member 38, which is also shown in FIG. 2, mounts the heat fins 14. In the cross-section of FIG. 7, two of the heat fins 14 are shown at the cross-sectional plane. In the illustrated embodiment, the lower face 38B of the base carrier plate member 38 extends radially outwardly to an upwardly-extending first outside wall 42 of the base carrier periphery 10. As best shown in FIGS. 2 and 6, the first outside wall 42 of the base carrier periphery 10 has a scalloped configuration, with the scallop pattern repeating at each heat fin 14. Other outside wall configurations, such as circular, could also be used.

Beginning at the top of the first inside wall 40 of the base carrier periphery 10, a main-lens support surface 44 of the base carrier periphery is formed. The main-lens support surface 44 is configured as a radially-extending annular shoulder situated above and peripherally outboard from the lighting-support surface 38A/18. This shoulder extends radially outwardly from an interior edge where the main-lens support surface 44 meets the top of the first inside wall 40 of the base carrier periphery 10, to an inside corner where it meets an upwardly-extending second inside wall 46 of the base carrier periphery 10. Beginning at the top of the first outside wall 42 of the base carrier periphery 10, a radially-extending lower annular shoulder 48 of the base carrier periphery is formed. The lower annular shoulder 48 extends radially outwardly from an inside corner where it meets the top of the first outside wall 42 of the base carrier periphery 10, to an outside corner where it meets an upwardly-extending second outside wall 50 of the base carrier periphery. The second outside wall 50 is circular in shape and parallel to the second inside wall 46. It provides a main outer rim of the light source module 2. Non-circular configurations could also be used.

The second outside wall 50 of the base carrier periphery 10 extends upwardly from an outside edge of the lower annular shoulder 48 of the base carrier periphery to a radially-extending upper annular shoulder 52 of the base carrier periphery. The upper annular shoulder 52 of the base carrier periphery 10 extends inwardly from the upper edge of the second outside wall 50 of the base carrier periphery to an inside corner at the base of an upwardly-extending base carrier lens retaining flange 54.

The retaining flange 54 is used to permanently secure a light-transmitting main lens 56 of the light source module 2 that is supported (directly or indirectly) on the base carrier upper side 6 by the main-lens support surface 44. As shown in FIG. 7, the main lens 56 has a main lens lower side 56A facing toward the light-emitting devices 24, and a main lens upper side 56B facing away from the light-emitting devices. The main lens 56 is shown non-cross-sectionally in FIG. 3. To secure the main lens 56, an upper free-end portion of the retaining flange 54 is deformed into a main-lens retaining lip 58 that folds over to capture the main lens on the main lens upper side 56B (via a flange 72 of a ring structure 68 described below). In the present embodiment, a roller-forming technique is used to form the main-lens retaining lip 58. FIGS. 8A and 8B illustrates this procedure, with FIG. 8A showing an initial undeformed state of the retaining flange 54, and FIG. 8B showing the retaining flange following formation of the main-lens retaining lip 58. Other forming techniques could also be used. Advantageously, the main-lens retaining lip 58 allows the main lens 56 to be retained in a permanent manner without the use of fasteners. Notwithstanding this advantage, fasteners may be used to retain the main lens 56 if so desired.

It will be seen in FIGS. 7, 8A and 8B, that there is an interior space 60 between the lens and the light-emitting device board 20. The height of the interior space 60 is determined by the height of the first inside wall 40 of the base carrier periphery 10, plus the thickness of a thin gasket 62 disposed between the main lens lower side 56A and the main-lens support surface 44. The gasket 62 is shown non-cross-sectionally in FIG. 3. The gasket 62 can be made from PTFE (polytetrafluoroethylene) or other suitable material. The gasket 62 functions to seal the upper side of the interior space 60 to prevent flammable materials and moisture from reaching the device electronics from above the main lens 56. As previously mentioned, the epoxy 36 disposed in the wiring port 30 is provided to prevent flammable materials and moisture from reaching the device electronics via the mounting stem 10.

Notwithstanding these precautions, it is necessary to design the light source module 2 to withstand internal explosions in the event that flammable materials do in fact reach the device electronics. Ignition of such materials can potentially result from contact with heat or an electrical spark emanating from the light-emitting device board 20 or the electrical connections thereto. To prevent exploding materials from escaping the interior space 60 (where they could ignite flammable materials outside the light source module 2), the main lens 56 is formed from chemically strengthened glass with a carefully-selected thickness dimension. In particular, the thickness dimension of the main lens 56 is selected to be large enough to resist the pressure forces generated by an internal explosion, yet not so large as to impede or complicate the above-described formation of the main lens retaining lip 58. It is also advantageous to minimize the thickness of the main lens 56 in order to reduce the weight of the light source module 2, thereby enhancing its portability.

In the illustrated embodiment, the main lens is a chemically strengthened alumino-silicate glass. For this embodiment, the main lens 56 is configured as a flat disk of uniform thickness having a diameter of approximately 120 mm. The diameter of the main lens 56 represents its maximum dimension. The thickness dimension of the main lens 56 represents the distance between the main lens lower side 56A and the main lens upper side 56B, both of which are substantially planar in the illustrated embodiment.

For the illustrated embodiment wherein the main lens 56 is formed of the chemically-strengthened alumino-silicate glass material at a diameter of approximately 120 mm, applicant has determined that the main lens thickness need not exceed approximately 3 mm in order to safely resist explosive forces generated within the interior space 60. As used in this context, the term "approximately" encompasses at least +/−10%. This corresponds to a ratio of maximum dimension to thickness dimension of approximately 40:1. Again, the term "approximately" encompasses at least +/−10% in this context.

In other embodiments, the maximum dimension of the main lens 56 may be larger or smaller than 120 mm. The explosive forces on the main lens 56 will be correspondingly larger or smaller as the surface area of the main lens increases or decreases. In that case, the thickness of the main lens 56 can be adjusted as needed to provide the required strength. For a lens having a flat circular construction, the maximum material stress due to a uniform pressure load varies with both the square of the diameter and the thickness. This means that in order to maintain the same stress level as the lens diameter changes, a directly proportional change in the lens thickness should be made. This can be achieved by using the above-mentioned ratio of approximately 40:1 to calculate the main lens thickness for any given main lens diameter.

Although the illustrated embodiment utilizes a main lens 56 that is configured as a flat disk, other embodiments could utilize other lens configurations, such as lenses that are flat but not circular, or lenses that are non-flat, such as dome lenses.

With continuing reference to FIGS. 7, 8A and 8B, the light source module 2 of the illustrated embodiment further includes a light-transmitting protective lens 64 disposed above the main lens 56, and separated therefrom by an empty space 66. The protective lens 64 is shown non-cross-sectionally in FIG. 3. The protective lens 64 functions to protect the main lens 56 against impacts. It can be formed from any suitable impact-resistant thermoplastic polymer, such as a light-transmitting polycarbonate material. The protective lens 64 includes a protective lens lower side 64A facing toward the main lens 56 and a protective lens upper side 64B facing away from the main lens.

The protective lens 64 is carried by a protective lens holder 68 supported (directly or indirectly) by the main lens 56. The protective lens holder 68 is formed from a suitable metal, such as low copper-content aluminum. It is a ring structure that is somewhat smaller in diameter than the base carrier periphery 10. In the illustrated embodiment, the protective lens holder includes an inside shoulder 70 that carries the protective lens 64, a first lens holder flange 72, and a second lens holder flange 74. The first lens holder flange 72 extends radially outwardly, and is tightly sandwiched between the main lens upper side 56B and the underside of the main-lens retaining lip 58. The second lens holder flange 74 extends vertically, and terminates at a thinned free end reduced thickness. The protective lens 64 is permanently secured to the base carrier 4 by virtue of this thinned portion of the second lens holder flange 74 being deformed into a protective-lens retaining lip 76 that folds over to capture the protective lens on the protective lens upper side 64A. In the illustrated embodiment, a roller-forming technique may be used to form the protective-lens retaining lip 76. FIGS. 8A and 8B illustrates this procedure, with FIG. 8A showing an initial undeformed state of the terminal end of the second lens holder flange 74, and FIG. 8B showing the second lens holder flange following formation of the protective-lens retaining lip 76. Other forming techniques could also be used. Advantageously, the protective-lens retaining lip 76 allows the protective lens 64 to be retained in a permanent manner without the use of fasteners. Notwithstanding this advantage, fasteners may be used to retain the protective lens 64 if so desired.

Figure 9:
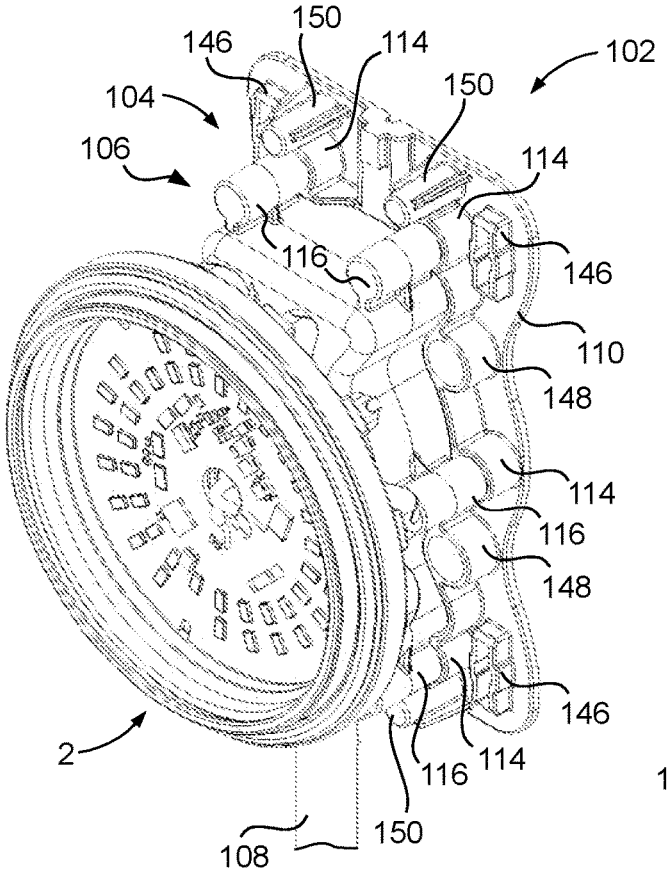
FIG. 9 is a front perspective view showing a portable modular hazardous location light assembly that incorporates the light source module of FIG. 1 in a single-head unit configuration.
Figure 10:
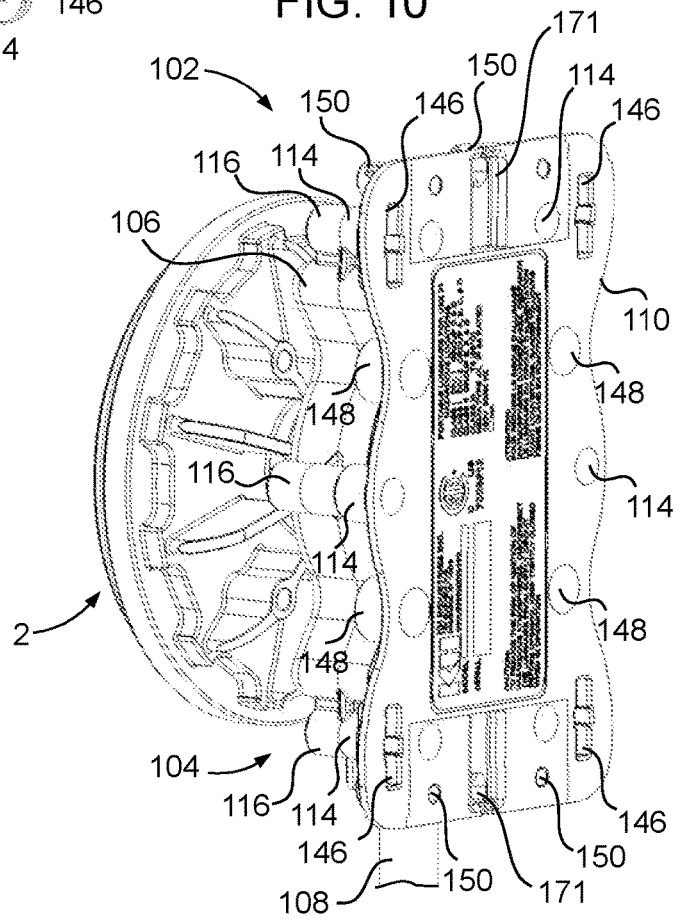
FIG. 10 is a rear perspective view of the single-head unit of FIG. 9.

Turning now to FIGS. 9 and 10, a portable modular hazardous location light assembly 102 is shown to illustrate a further aspect of the present disclosure. In the illustrated embodiment, the light assembly 102 mounts a single one of the light source modules 2, and may thus be referred to as a single-head unit. The light assembly 102 includes a single-head housing 104 that may be constructed from any suitably rugged and durable material, such as a moldable high-strength polymer. A highly conductive polymer is particularly advantageous in order to reduce the possibility of static charge build-up.

Figure 11:
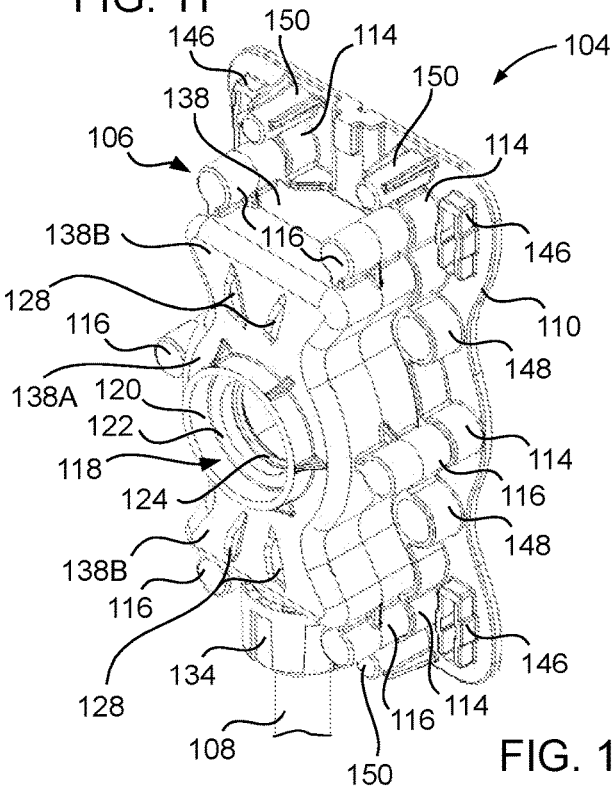
FIG. 11 is a front perspective view of a housing of the single-head unit of FIG. 9.
Figure 12:
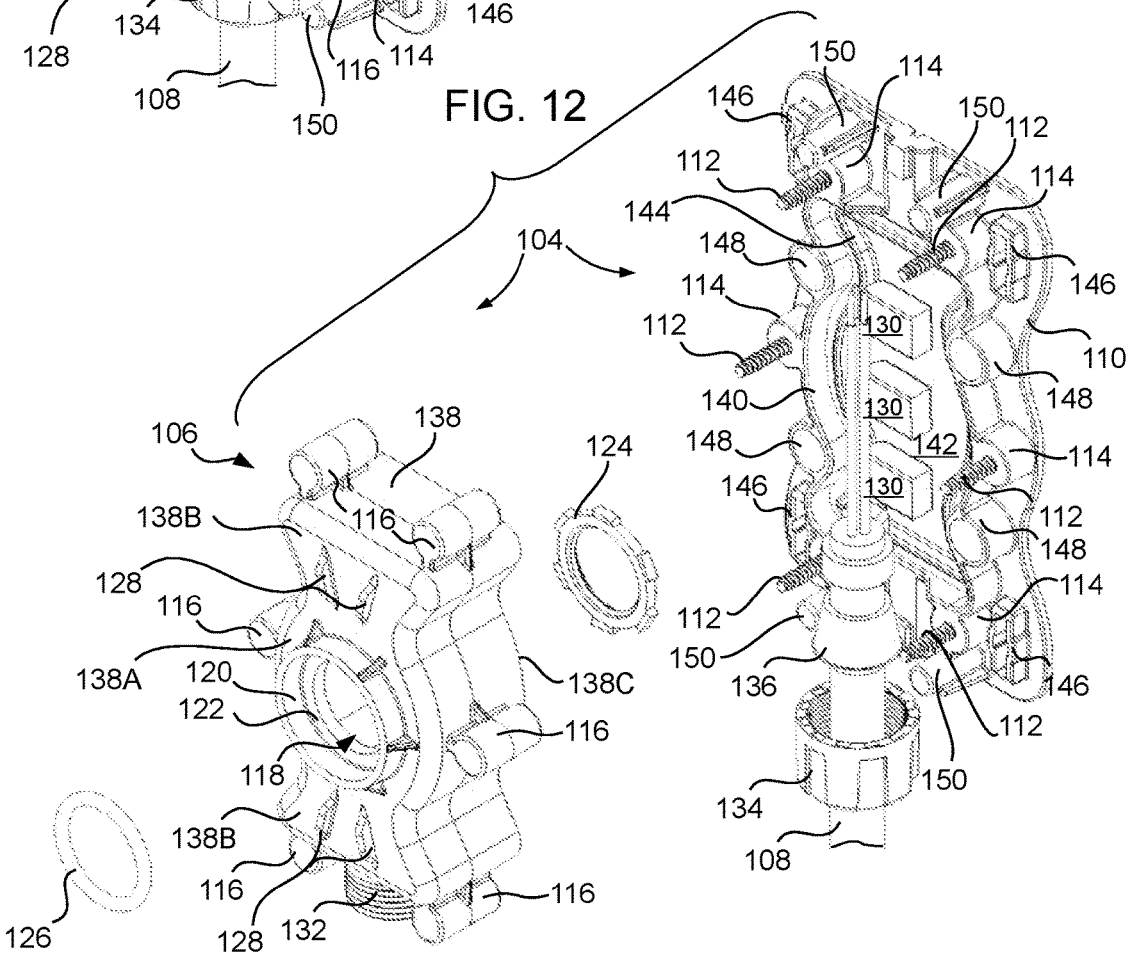
FIG. 12 is an exploded front perspective view of the single-head housing of FIG. 11.

As additionally shown in FIGS. 11 and 12, the single-head housing 104 includes an enclosure 106 that mounts the light source module 2 on a front wall thereof, and whose interior contains electrical connections (not specifically shown) between the end of an electrical power cord 108 and the electrical wiring 28 of the light source module 2. The light assembly 102 further includes a removable cover 110. As shown in FIG. 12, the cover 110 is removably secured to the rear of the enclosure 106 using six fasteners 112. As additionally shown in FIG. 10, the fasteners 112 enter the back of the removable cover 110 through fastener-receiving pockets 114 formed with through-holes into which the fasteners 112 extend. As additionally shown in the FIGS. 9 and 11, the fasteners 112 thread into the enclosure 106, which has six fastener-receiving mounting bosses 116 formed with rear-facing blind bores.

As can be seen in FIGS. 11-12, the front side of the enclosure 106 has a large mounting port 118 configured to receive the mounting stem 12 of the light source module 2. Surrounding the mounting port 118 is a ring flange 120 whose inside wall is sized to engage the outside of the non-threaded enlarged-diameter portion 12B of the light source module's mounting stem 12 (see FIG. 2). At the base of the inside wall of the ring flange 120 is an annular shoulder 122. The annular shoulder 122 is sized to engage the free end of the mounting stem's enlarged-diameter portion 12B, while allowing the threaded portion 12A of the mounting stem 12 to pass into the interior of the enclosure 106.

To secure the light source module 2 to the light assembly 102, a lock-nut 124 (shown in both of FIGS. 11 and 12) is provided on the inside of the enclosure 106, where it threads onto the mounting stem's threaded portion 12A. A resilient O-ring compression seal 126 (shown in FIG. 12) fits into the annular pocket 12C of the light source module's mounting stem 12 (see FIG. 2) and seals against the annular shoulder 122. The seal 126 prevents flammable materials and moisture from entering the interior of the enclosure 106 via the mounting port 118. To prevent against unwanted rotation of the light source module 2, the front of the enclosure 106 is formed with upper and lower pairs of blind anti-rotation slots 128. Each pair of the anti-rotation slots 128 is arranged and oriented to receive a pair of adjacent heat fins 14 of the base carrier 4, thereby locking the light source module 2 against rotation.

As shown in FIG. 12, the interior of the enclosure 106 may be provided with wiring connectors 130 that mount to the removable cover 110. The wiring connectors 130 are used to make electrical connections between the electrical wiring of the incoming power cord 108 and the electrical wiring 28 of the light source module 2. The power cord 108 enters the enclosure 106 through the opening (not shown) of an externally-threaded power cord port 132. A wire retainer nut 134 threads onto the power cord port 132 and compresses a resilient strain-relief grommet 136. This arrangement secures the cord and provides a seal that prevents flammable materials and moisture from entering the interior of the housing 104 via the power cord port 132.

The housing 104 may be configured in various shapes. In the illustrated embodiment of FIGS. 11-12, the enclosure 106 includes a substantially hollow shell 138 having what may be referred to as a mirrored key-hole configuration. This shell configuration includes a central circular portion 138A where the mounting port 118 is formed. The shell configuration further includes a pair of mirrored upper and lower trapezoidal portions 138B respectively extending above and below the circular portion 138A. The trapezoidal portions 138B of the shell 138 are where the anti-rotation slots 128 are situated. The previously-mentioned fastener-receiving mounting bosses 116 of the enclosure 106 are mounted on the outside wall of the shell 138.

The removable cover 110 of the housing 104 has a shaped periphery that corresponds to the shell 138, but is larger so as to extend beyond a rear edge 138C of the shell. As can be seen in FIG. 12, the front side of the removable cover 110 is formed with a guide flange 140 that defines a pocket 142 whose size and shape matches the size and shape of the shell's rear edge 138C. Disposed at the inside base of the flange 140 is a resilient compression seal 144 that sealingly engages the rear edge 138C when the removable cover 110 is secured to the enclosure 106. The seal 144 prevents flammable materials and moisture from entering the interior of the housing 104 at the interface between the enclosure 106 and the removable cover 110. The peripheral portion of the removable cover 110 that extends beyond the flange 140 is where the fastener-receiving pockets 114 are formed.

As best shown in FIG. 10, but also visible in FIGS. 9, 11 and 12, the removable cover 110 is configured with various apertured attachment bosses that may be used to attach different mounting accessories to the light assembly 102. These accessory attachment bosses include four slotted bosses 146, four circular large-bore bosses 148, and four circular small-bore bosses 150.

Figure 13:
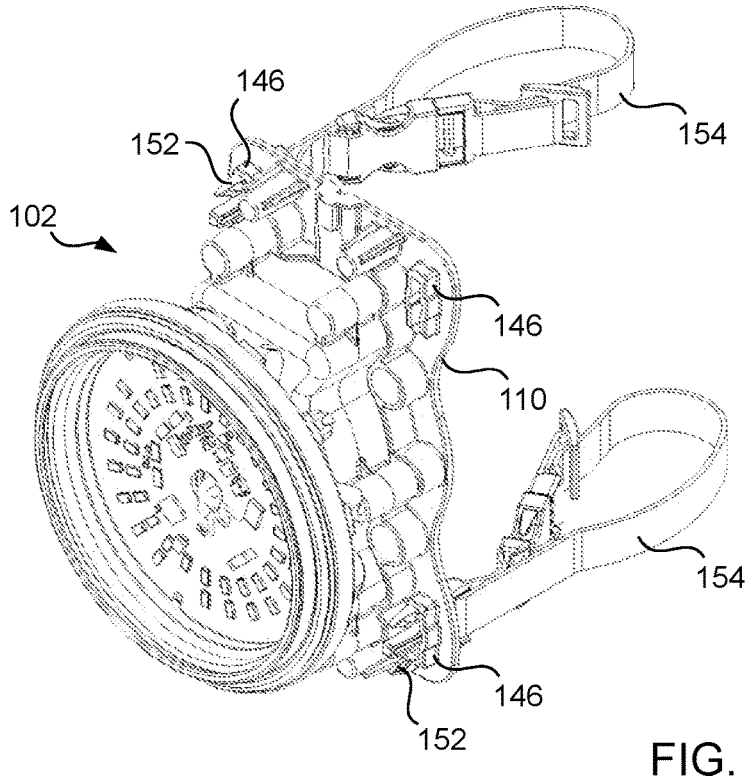
FIG. 13 is a front perspective view of the single-head unit of FIG. 9 in an example deployment configuration that includes mounting straps.

As can be seen in FIG. 13, the four slotted bosses 146 of the removable cover 110 may be used to attach buckles 152 that are each secured to a light-assembly hanging strap 154. The straps 154 allow the light assembly 102 to be hung from an overhead support structure (not shown) so that the light assembly can illuminate a work area from above.

Figure 14:
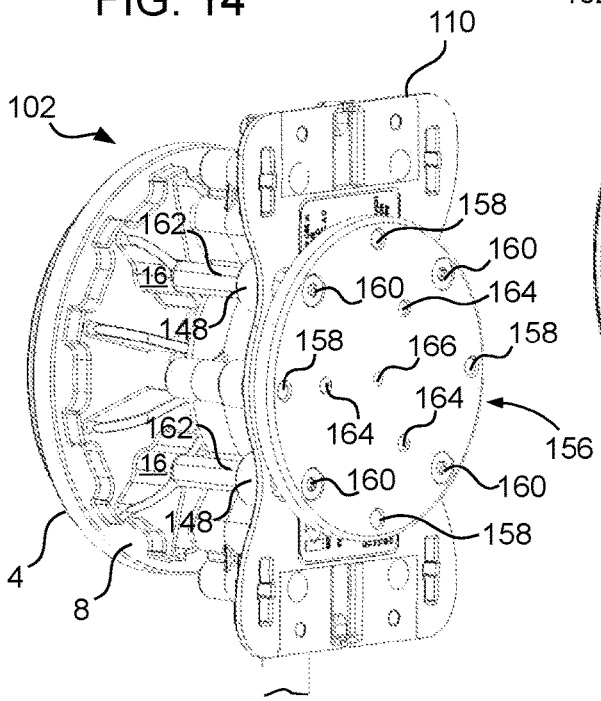
FIG. 14 is a rear perspective view of the single-head unit of FIG. 9 configured with a universal mounting attachment.

As can be seen in FIG. 14, the four circular large-bore bosses 148 of the removable cover 110 may be used to attach a universal mounting element 156 that can be used to mount the light assembly 102 to a wide variety of support structures (not shown). In the illustrated embodiment, the universal mounting element 156 is configured as a plate having multiple mounting apertures that may be of varying size. One set of eight mounting apertures 158 is arranged around the perimeter of the universal mounting element 156. Four of these apertures receive fasteners 160 that extend through the large-bore mounting bosses 148 to the light source module 2. There, they attach to the mounting holes 16 on the base carrier lower side 8. Between the mounting bosses 148 and the mounting holes 16, the fasteners 160 extend through apertured spacers 162 that prevent deformations of the base carrier 4 and/or the removable cover 110 that could result from fastener over-tightening. It will be seen in FIG. 14 that the spacers 162 are accommodated by a narrowing of the trapezoidal portions 138B of the shell 138 proximate to where they meet the shell's circular portion 138A.

Another set of three smaller mounting apertures 164 of the universal mounting element 156 is arranged in a triangular pattern inside of the pattern of mounting apertures 158. A single mounting aperture 166 of still smaller size is located at the center of the universal mounting element 156. It will be appreciated that many other mounting aperture arrangements could likewise be provided.

Figure 15:
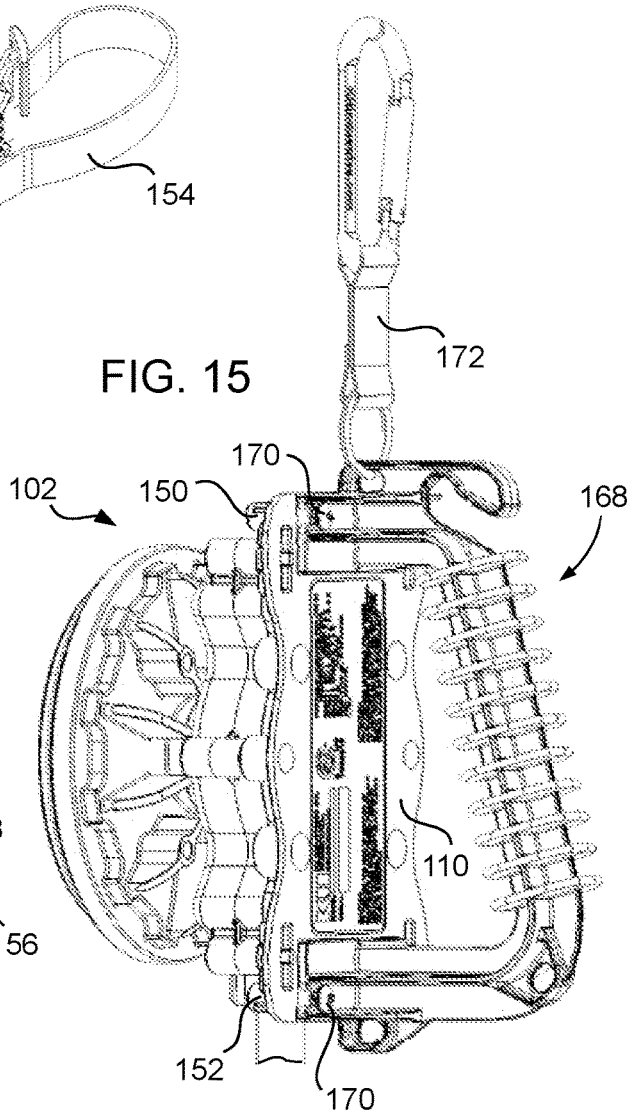
FIG. 15 is a front perspective view of the single-head unit of FIG. 9 in another example deployment configuration that includes a handle and a lanyard.

As can be seen in FIG. 15, the four circular small-bore bosses 150 of the removable cover 110 may be used to attach a carrying handle 168 for hand-carrying the light assembly 102. Fasteners 170 may be used to attach the handle 168. As shown in FIG. 10, the removable cover 110 may be formed with upper and lower handle alignment slots 171 that engage corresponding lands (not shown) on the handle 168. The handle 168 itself may carry additional mounting accessories, such as an lanyard 172.

Figure 16:
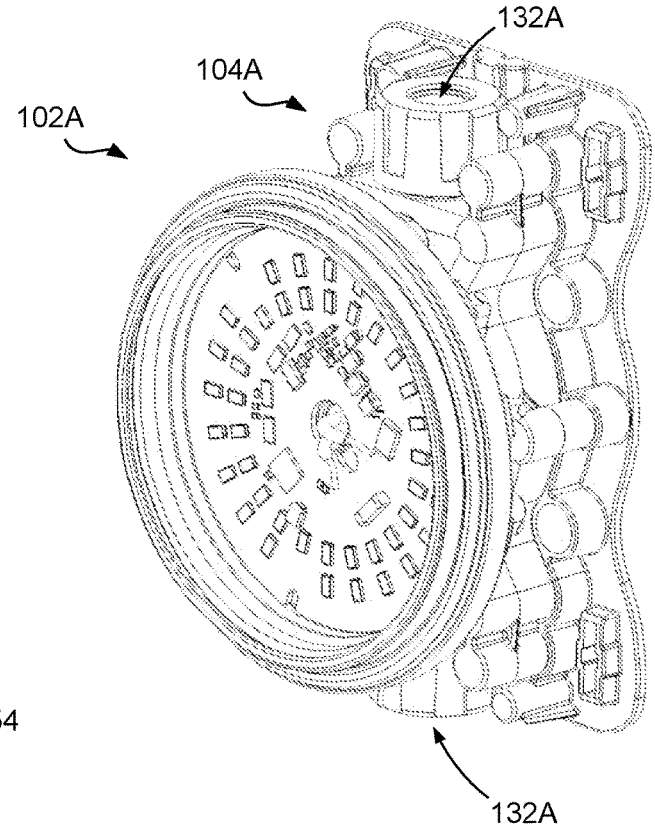
FIG. 16 is a front perspective view of a modified version of the single head unit of FIG. 9 configured for feed-through wiring.

Briefly referring back to FIG. 12, it will be seen that the light assembly 102 has only a single power cord port 132 located at on end of the housing 104. The other end of the housing 104 is closed and has no power cord port. As such, the light assembly 102 may be characterized as a single-head, dead end unit that connects to the end of a single power cord 108. Turning now to FIG. 16, a modified light assembly 102A is shown that is identical in all respects to the light assembly 102 of FIGS. 9-12, except that it has two power cord ports 132A-1 and 132A-2, respectively located at the ends of the housing 104A. The modified light assembly 102A may be thus be characterized as a single-head, feed-through unit that can be connected to the ends of two power cords 108.

Figure 17:
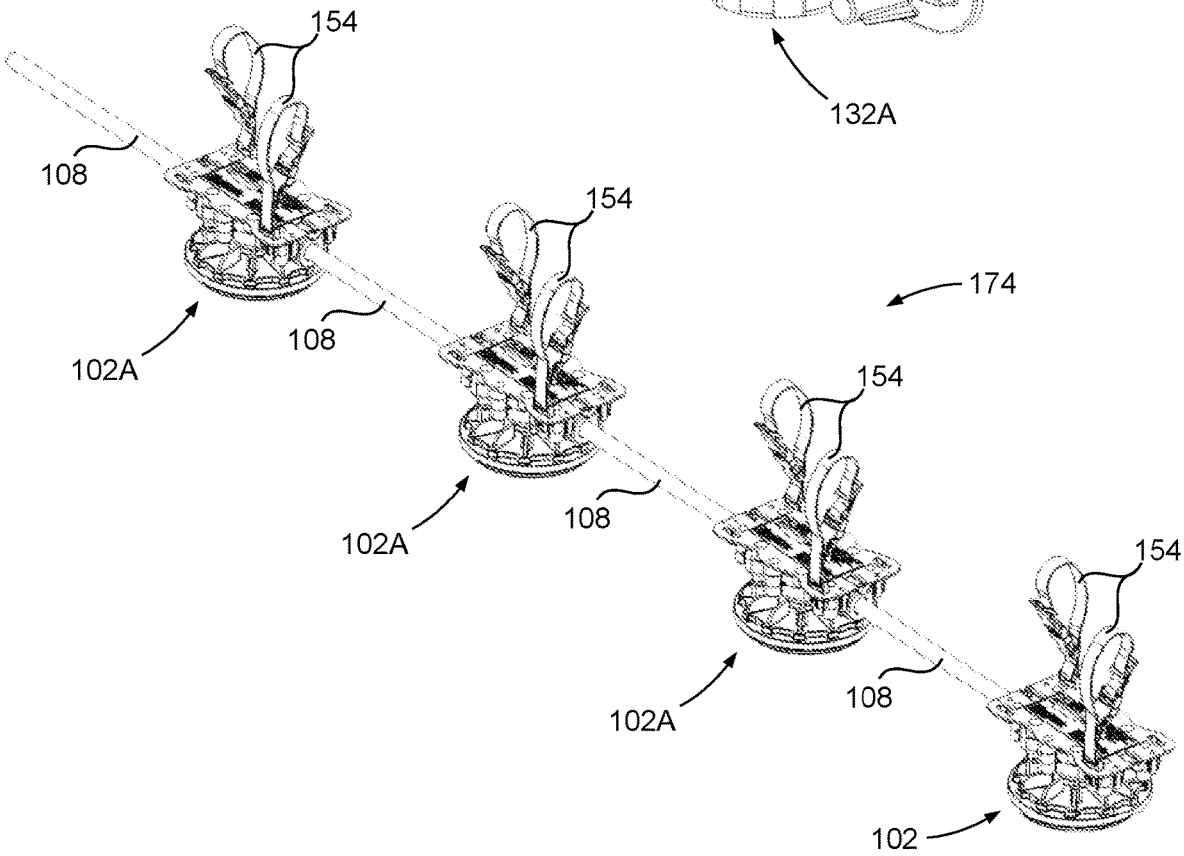
FIG. 17 is a perspective view showing a portable hazardous location light string that includes a string of the single-head units of FIGS. 9 and 16.

Turning now to FIG. 17, a lighting string 174 is shown that makes use of a combination of one single head, dead end unit 102 and three single-head, feed-through units 102A, all of which are connected by sections of the power cord 108. Many other combinations of light assemblies could likewise be used to form modified lighting string arrangements. The lighting string 174 may be used to string the light assemblies 102 and 102A around a large work area. In FIG. 17, each light assembly 102 and 102A includes the mounting straps 154 of FIG. 13, so that the light assemblies may be hung to provide overhead lighting.

As previously mentioned, the light assemblies 102 and 102A are configured as a single-head units because they mount only a single light source module 2. Turning now to FIGS. 18-28, an another light assembly 202 is shown that is configured as a multi-head unit that mounts multiple light source modules 2. More particularly, the light assembly 202 this embodiment mounts up to six of the light source modules 2. Any combination of up to six light source modules 2 may be mounted in order to achieve certain light patterns. By way of example, FIGS. 18-28 illustrate an embodiment in which five of the light source modules 2 are on an upper side of the light assembly 202. In this context, "upper" is relative to the light assembly orientation of FIGS. 18-26. When the light assembly is in an inverted orientation, as in FIGS. 27-28, the five light source modules 2 would be considered to be on the lower side of the light assembly 202. A central one of the five light source modules 2 points upwardly (or downwardly in FIGS. 27-28). The four remaining upper light source modules 2 point outwardly at an angle of approximately 60 degrees from horizontal. In the plan view orientation of FIG. 19, it will be seen that the four angled light source modules 2 surround the central light source module in a substantially square pattern due to these light source modules being equidistant from each other. As best shown in FIG. 20, the sixth light source module 2 is on a lower side of the light assembly 202, and points downwardly in FIGS. 18-26 (and upwardly in FIGS. 27-28).

The light assembly 202 includes a multi-head housing 204 that may be constructed from any suitably rugged and durable material, such as a moldable high-strength polymer that is highly conductive. As can be seen in FIG. 18-22, the multi-head housing 204 includes four support members 206 pivotally attached to corner portions of the housing. Each support member 206 includes a support leg 208 and a support foot 210. The support leg 208 and the support foot 210 are oriented substantially 90 degrees apart, with other angles also being possible. As between different support members 206, FIGS. 19 and 20 illustrate that the support feet 210 of adjacent support members are oriented to extend outwardly substantially 90 degrees from each other, such that all four support feet taken together form an "X" configuration.

Figure 27:
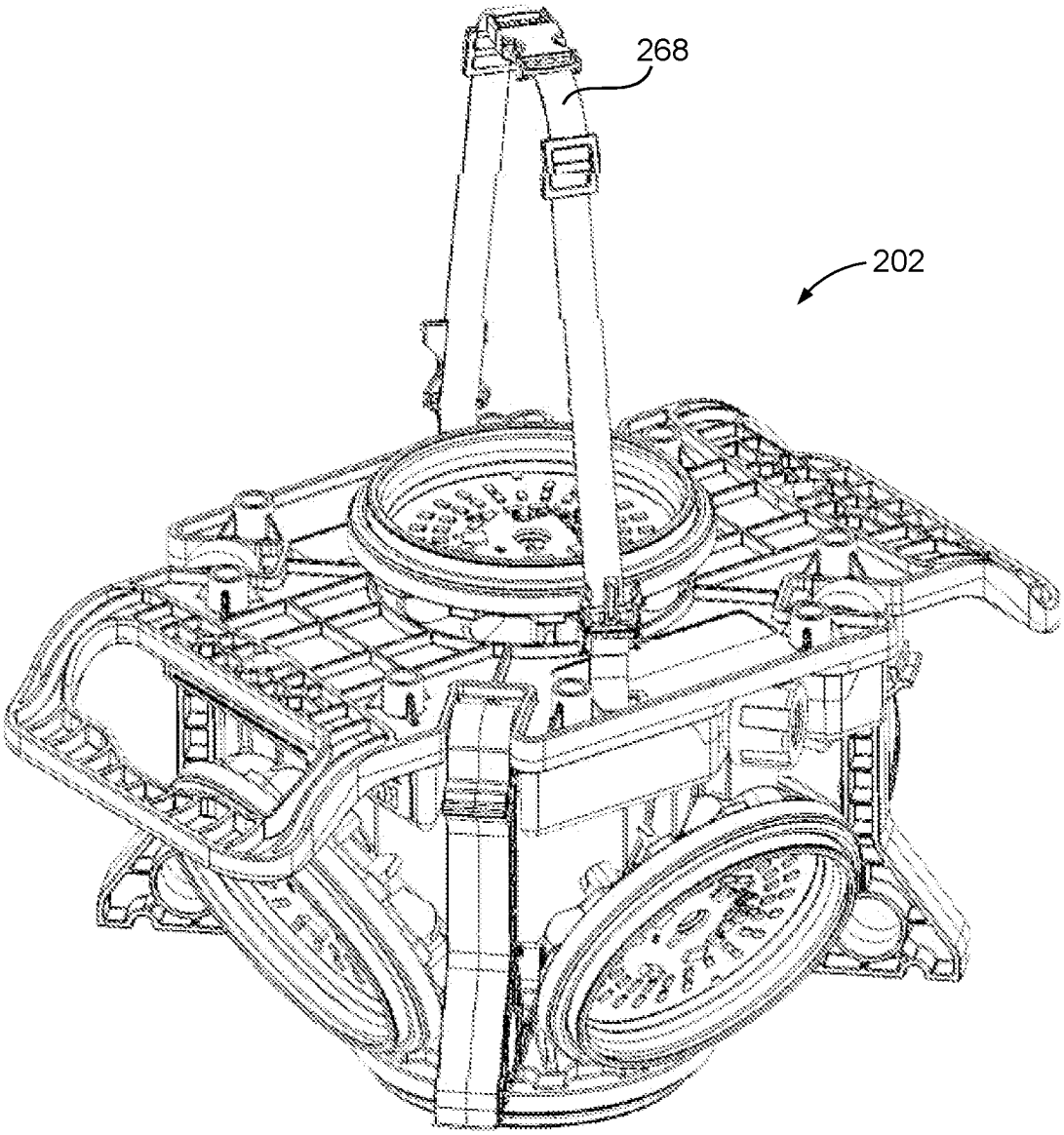
FIG. 27 is an upper perspective view of the multi-head unit of FIG. 18, with the legs of the unit being in a retracted position and the multi-head unit being in an overhead deployment configuration that utilizes a mounting strap.
Figure 28:
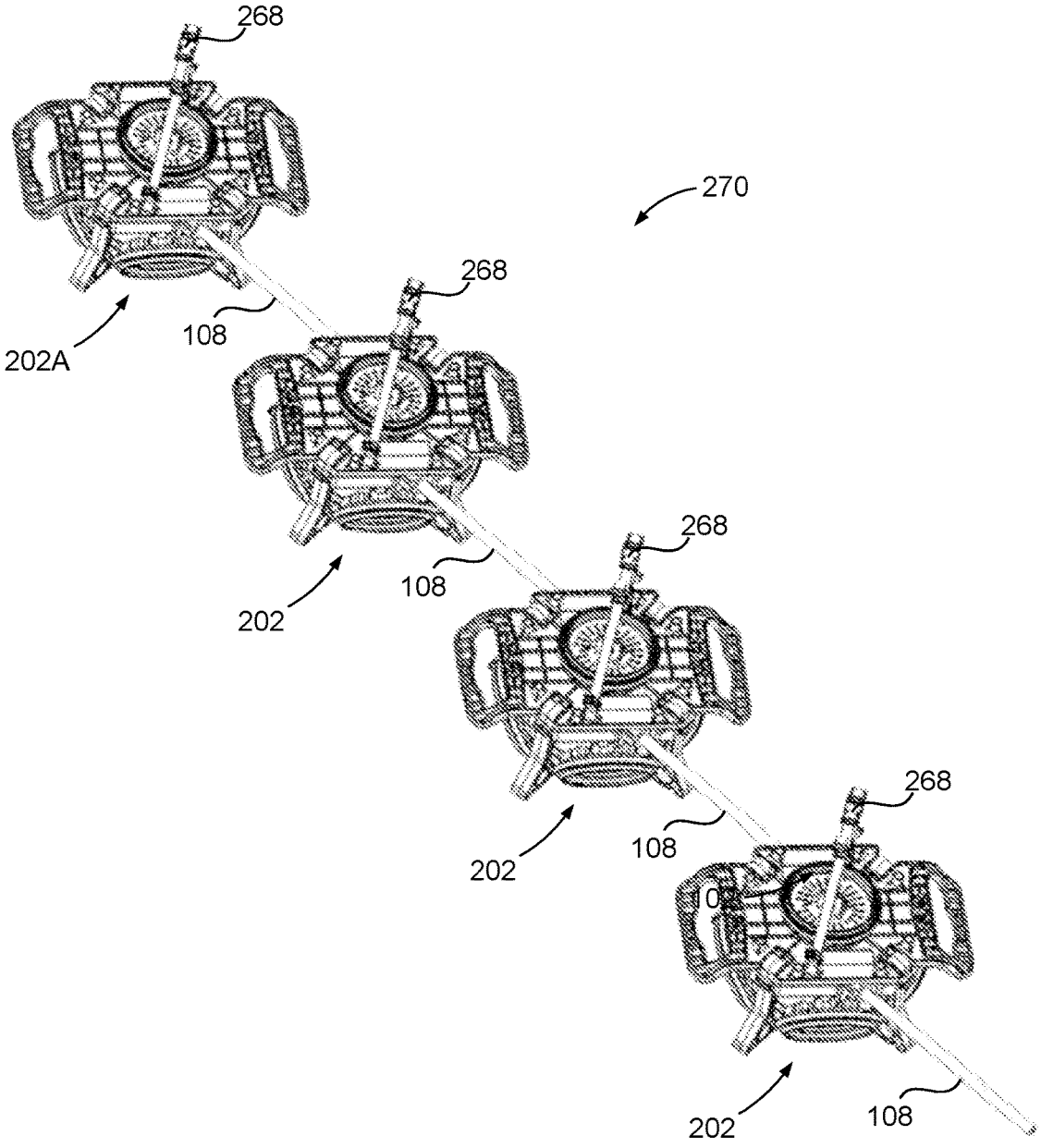
FIG. 28 is a perspective view showing a portable hazardous location light string that includes a string of the multi-head units configured as shown in FIG. 28.

The support members 206 are pivotally attached to the multi-head housing 204 so as to be movable between an extended position and a retracted position. FIGS. 18-23 and 26 illustrate the support members 206 in their extended position. In this position, the support members 206 can be used to support the light assembly 202 on an external surface (not shown), As described in more detail below in connection with FIG. 26, this position may be used to store the light assembly 202. Alternatively, it could be used as an operational position. FIGS. 27 and 28, described in more detail below, show the support members 206 in their retracted position. As described in more detail below, this position may be used for light assembly operation.

Figure 18:
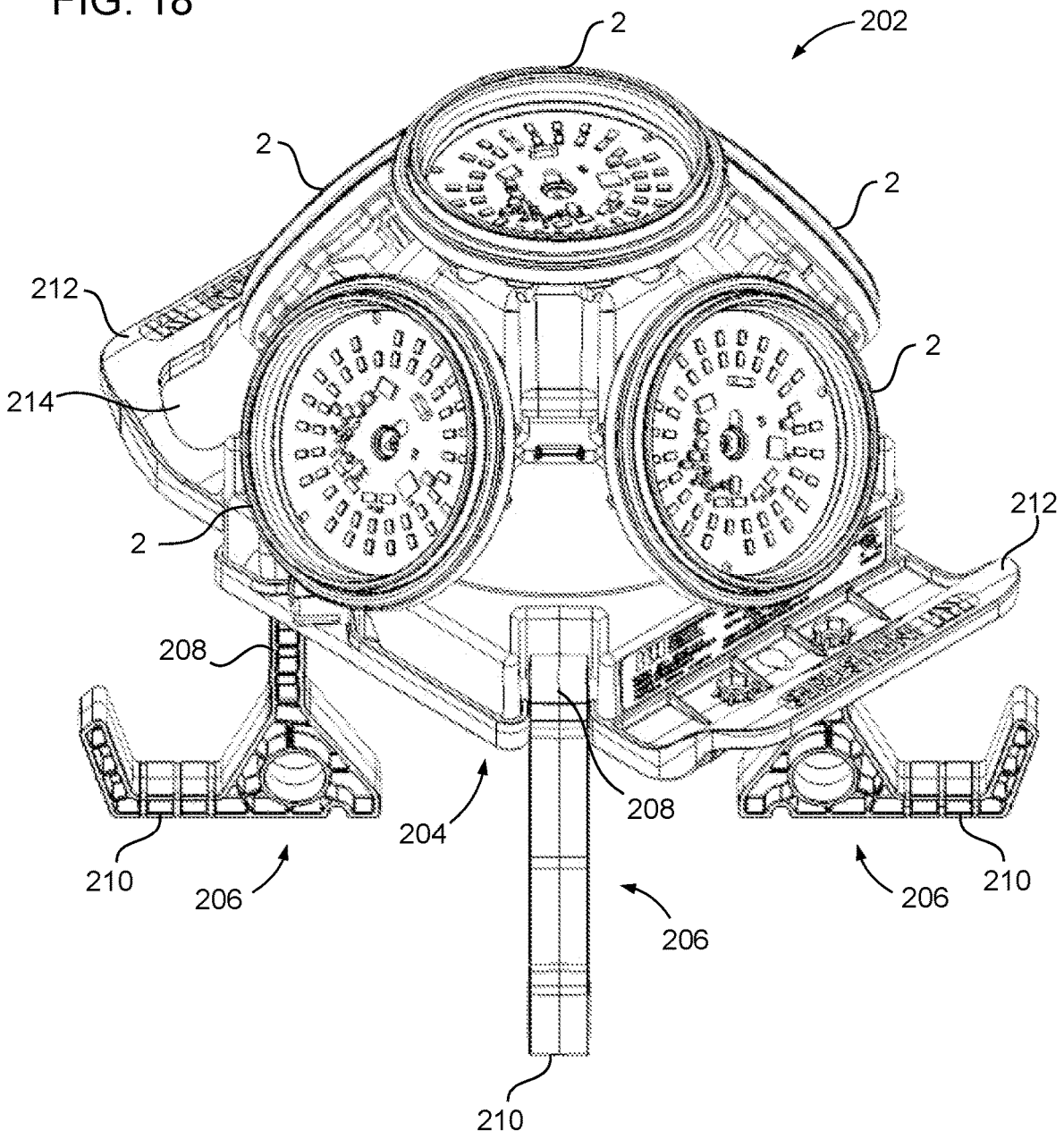
FIG. 18 is a upper perspective view showing a portable modular hazardous location light assembly that incorporates up to six of the light source modules of FIG. 1 in a multi-head unit configuration, with the legs of the multi-head unit being in an extended position.
Figure 19:
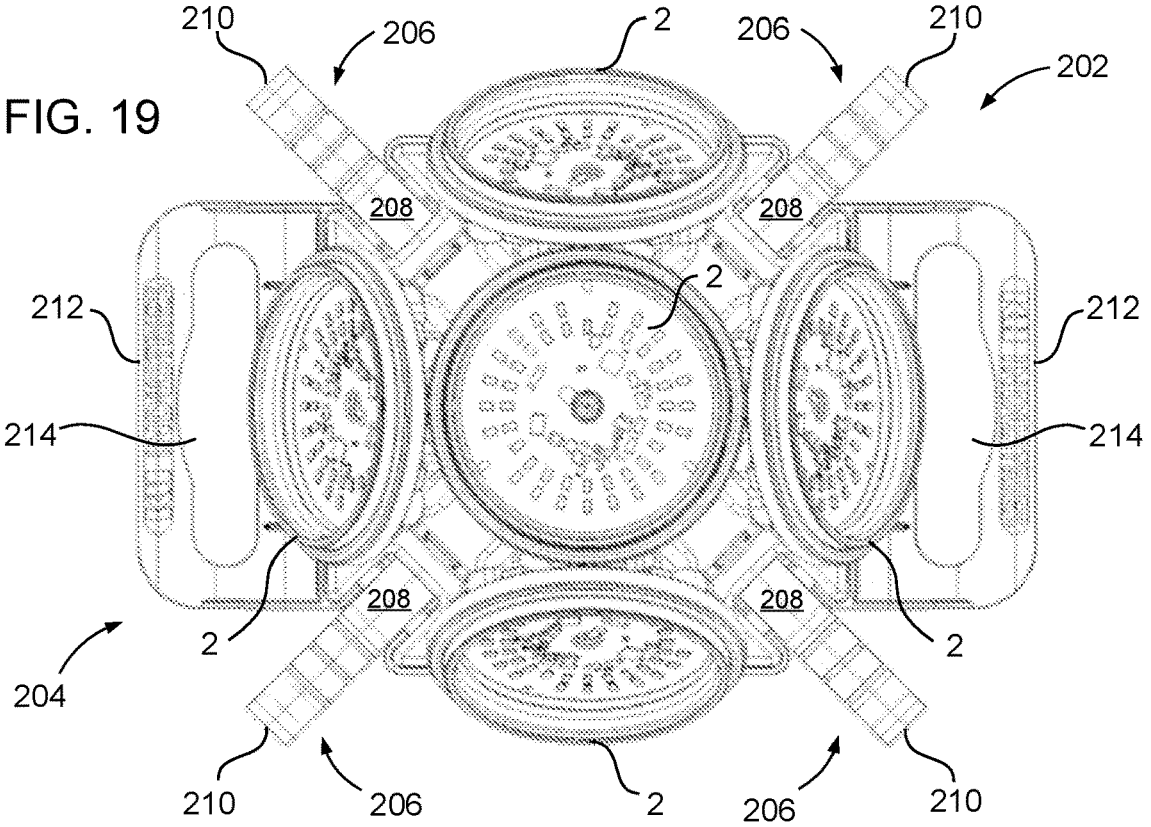
FIG. 19 is a top view of the multi-head unit of FIG. 18.
Figure 20:
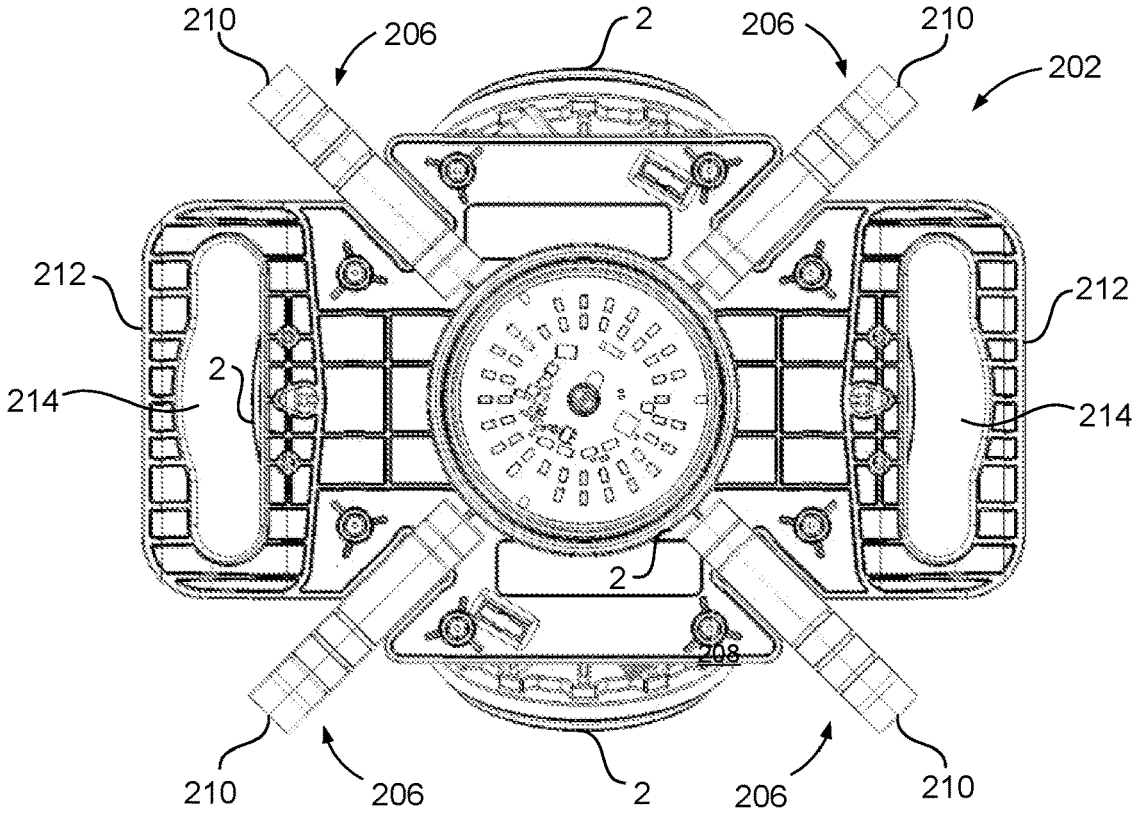
FIG. 20 is a bottom view of the multi-head unit of FIG. 18.

As can be seen in FIGS. 18-22, the multi-head housing 204 also includes a pair of carrying/wall-hanging handles 212 disposed on opposite sides thereof. As shown in FIGS. 18-20, each handle 212 may include an elongated slot 214 that may be used to facilitate carrying the light assembly 202. The handles 212 could also be used for hanging the housing 204 on a wall or other non-horizontal surface during light assembly operation (e.g., when the sixth light source module 2 is not present).

Figure 23:
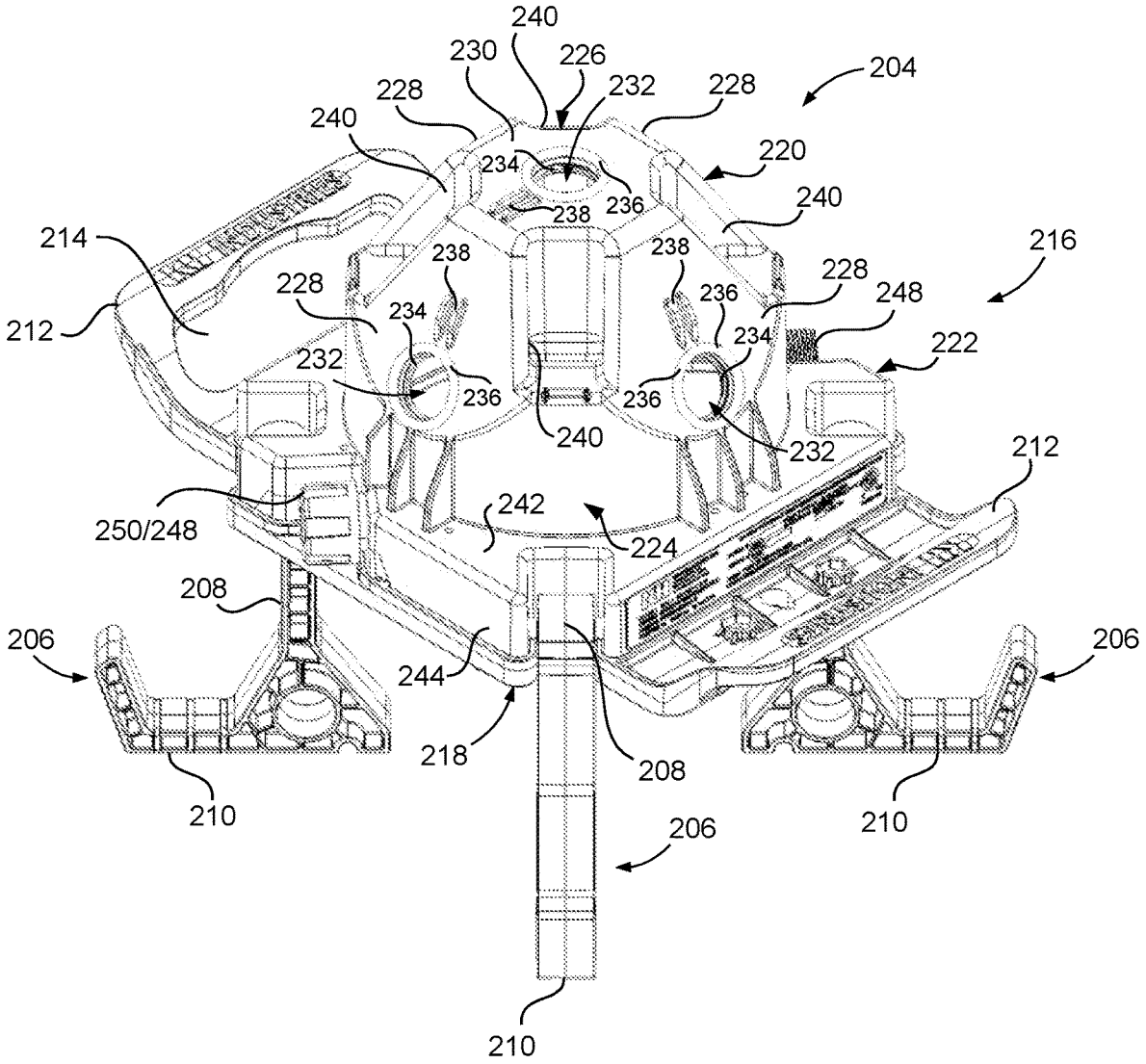
FIG. 23 is an upper perspective view of a housing of the multi-head unit of FIG. 18.
Figure 24:
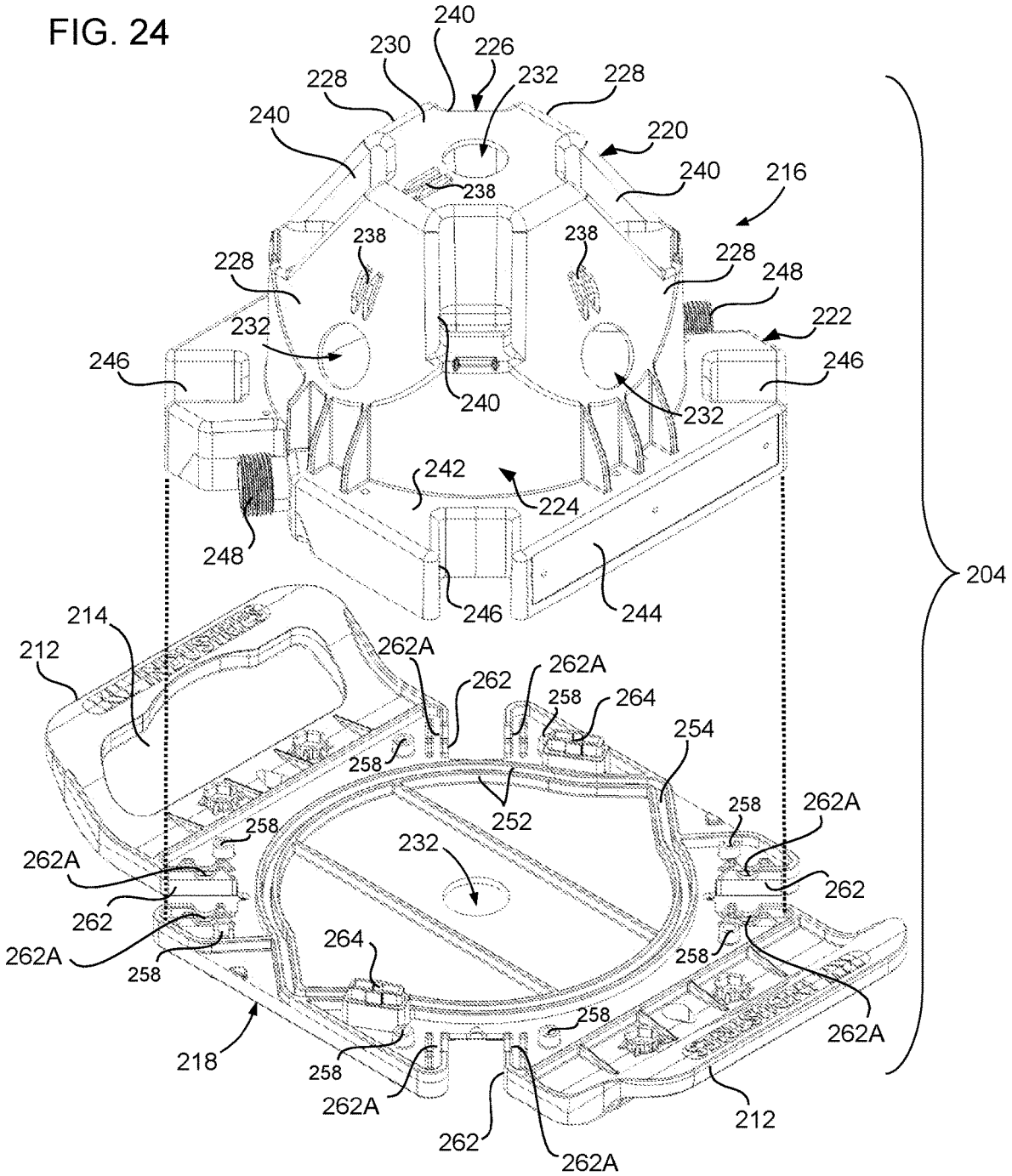
FIG. 24 is an exploded upper perspective view of the housing of FIG. 23.

Turning now to FIGS. 23 and 24, the multi-head housing 204 includes an enclosure 216 that mounts the five upper light source modules 2, and a removable cover 218 that mounts the single lower light source module. The enclosure 216 includes an enclosure dome 220 that extends upwardly from a box-like enclosure base 222.

The enclosure dome 220 is configured as a substantially hollow shell. It includes a lower dome portion 224 that is generally cylindrical where it meets the enclosure base 222, and an upper dome portion 226 having four flat angled panels 228 and a flat horizontal upper panel 230. Each of the flat panels 228 and 230 is formed with a large mounting port 232 configured to receive the mounting stem 12 of a light source module 2. A light source module 2 can be mounted and sealed to the mounting port 232 in a manner that is analogous to the mounting and sealing technique used for the single-head light assembly 102 described above. As shown in FIG. 23, a lock nut 234 is situated on the inside of the enclosure dome 220 for threading onto the threaded portion 12A of the light source module's mounting stem portion 12. A resilient O-ring 236 is situated on the outside of the enclosure dome 220 for fitting into the annular pocket 12C of the light source module's mounting stem 12. When the light source module 2 is thus mounted, the base of its mounting stem's enlarged diameter portion 12B of the mounting stem will but against the surface of the corresponding flat panel 228.

Adjacent to each mounting port 232 is a pair of parallel tabs that define a slot 238 on the flat panel 228. Each slot 238 is sized and located to receiving one of the heat fins 14 of a light source module 2 that mounts to the adjacent mounting port 232. This locks the light source module 2 against unwanted rotation.

Four pocket recesses 240 are formed at the corners formed by adjacent ones of the flat panels 238. As can be seen in FIG. 23, the pocket recesses 240 are sized and located to receive the toe ends of the feet 210 when the support members 206 are rotated to their retracted position (as depicted in FIGS. 27 and 28).

As can be seen in both FIGS. 23 and 24, the enclosure base 222 has a square box-like configuration that includes a flat horizontal top portion 242 and a vertical sidewall portion 244. A channel recess 246 is provided at each corner of the enclosure base 222 for pivotally mounting the support members 206. Any suitable pivotal connection may be used. Two externally-threaded power cord ports 248 are formed on opposite sides of the sidewall portion 244. One or both of the power cord ports may have a power cord-receiving opening (not shown) passing through the center of the port for receiving an electrical power cord (not shown). If both of the power cord ports 248 are formed with power cord-receiving openings, the light assembly 202 can be configured as a multi-head feed-through unit that receives two power cords. If only one of the power cord ports 248 is formed with a power cord-receiving opening, the light assembly 202 can be configured as a dead-end multi-head unit that receives only one power cord. Wire retainer nuts (one of which is shown by reference number 250 in FIG. 23) are provided for threading onto the power cord ports 248 for retaining the power cords by compressing a corresponding strain-relief grommet (not shown), as described above in connection with the single-head light assembly 102.

With continuing reference to FIGS. 23 and 24, the removable cover 218 of the enclosure 216, exclusive of the handles 216, has substantially flat configuration. As can be seen in FIG. 24, the top side of the removable cover 218 is formed with parallel guide flanges 252 that define a slot 254. With additional reference to FIG. 25, the slot 254 has a size and shape that matches the size and shape of an interior lower edge 256 that extends below the top portion 242 of the enclosure base 222. Although not shown, a resilient compression seal is provided in the slot 254 to sealingly engage the interior lower edge 256 when the removable cover 218 is secured to the enclosure 216. This seal prevents flammable materials and moisture from entering the interior of the enclosure dome 220 at the interface between the interior lower edge 256 and the removable cover 218. It will be seen in FIG. 25 that the interior lower edge 256 is generally circular and coextensive with the lower circular portion 224 of the enclosure dome, but flairs out in two locations 257 to merge with short sections 244A of the lower enclosure's vertical sidewall portion 244 that carry the power cord ports 228. The sealed interface between the interior lower edge 256 and the removable cover 218 will thus also prevent flammable materials and moisture from coming into contact with the power cord wiring that enters the enclosure 204 via one or both of the power cord ports 228.

Figure 21:
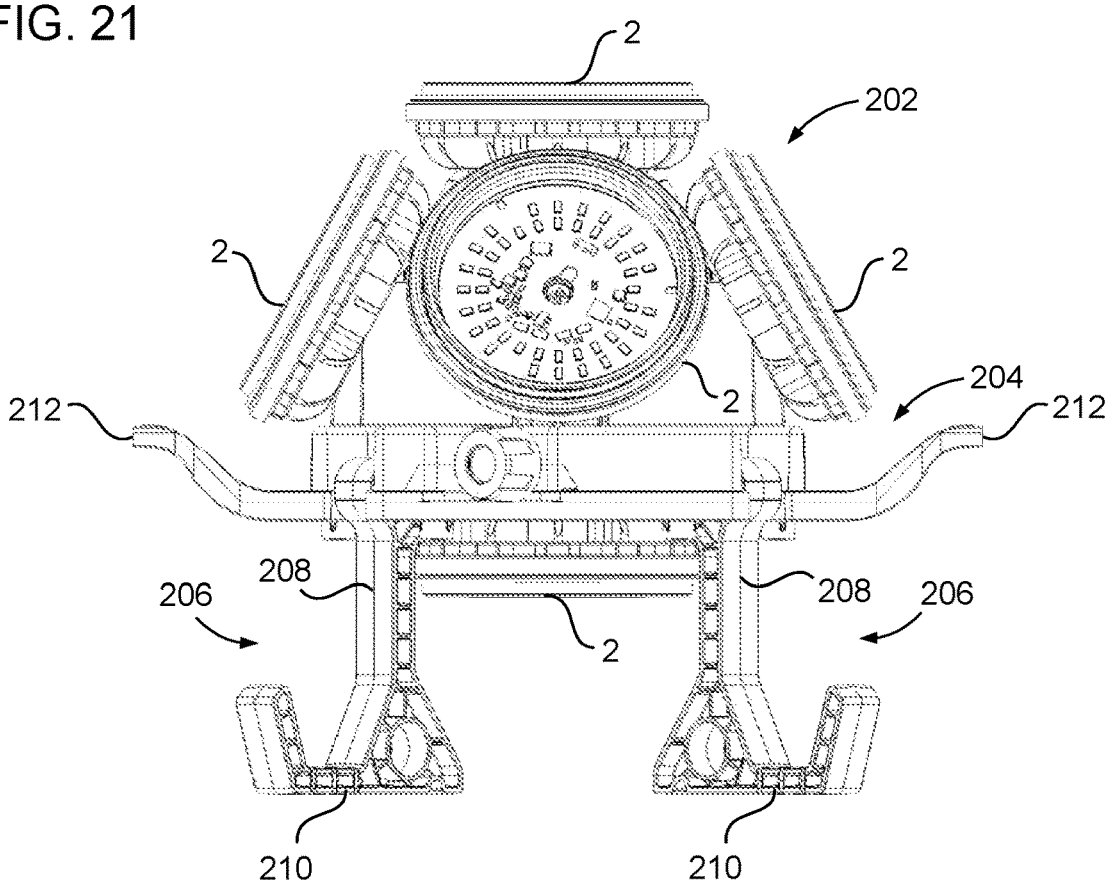
FIG. 21 is a side view of the multi-head unit of FIG. 18.
Figure 22:
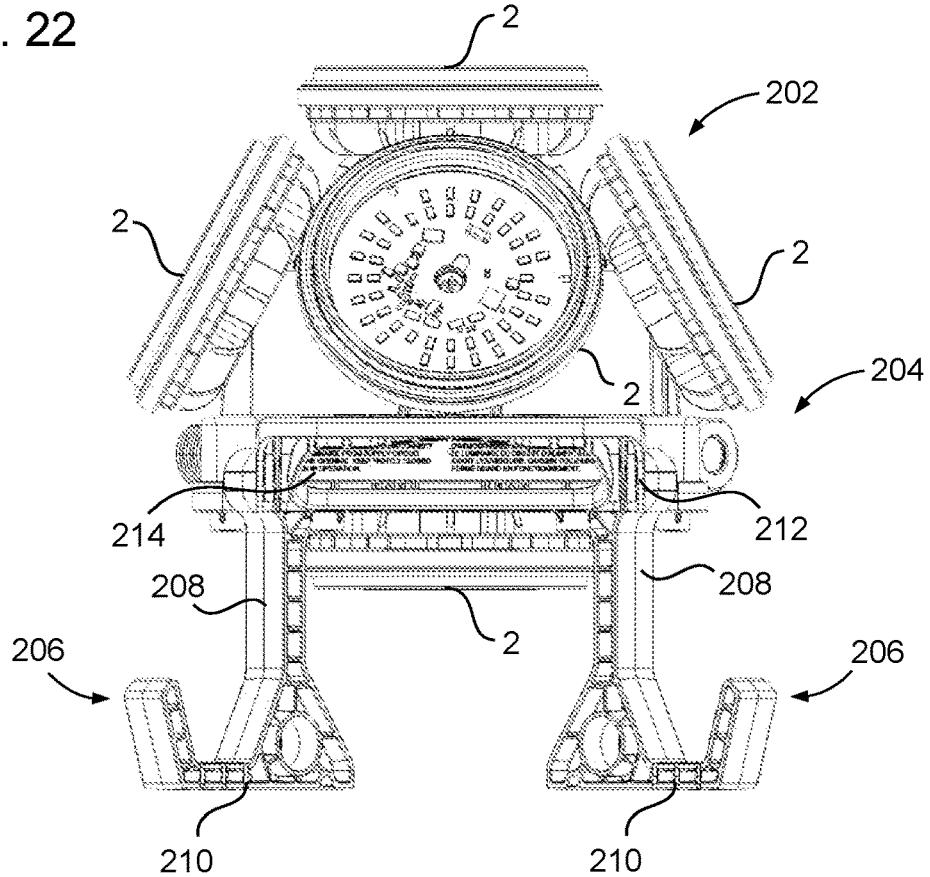
FIG. 22 is an end view of the multi-head unit of FIG. 18.

Situated at the center of the removable cover 218 is another large mounting port 232 for mounting the lower light source module 2 shown in FIGS. 20-22. This light source module 2 is mounted and sealed in the same manner as the five light source modules 2 mounted on the enclosure dome 220.

Figure 25:
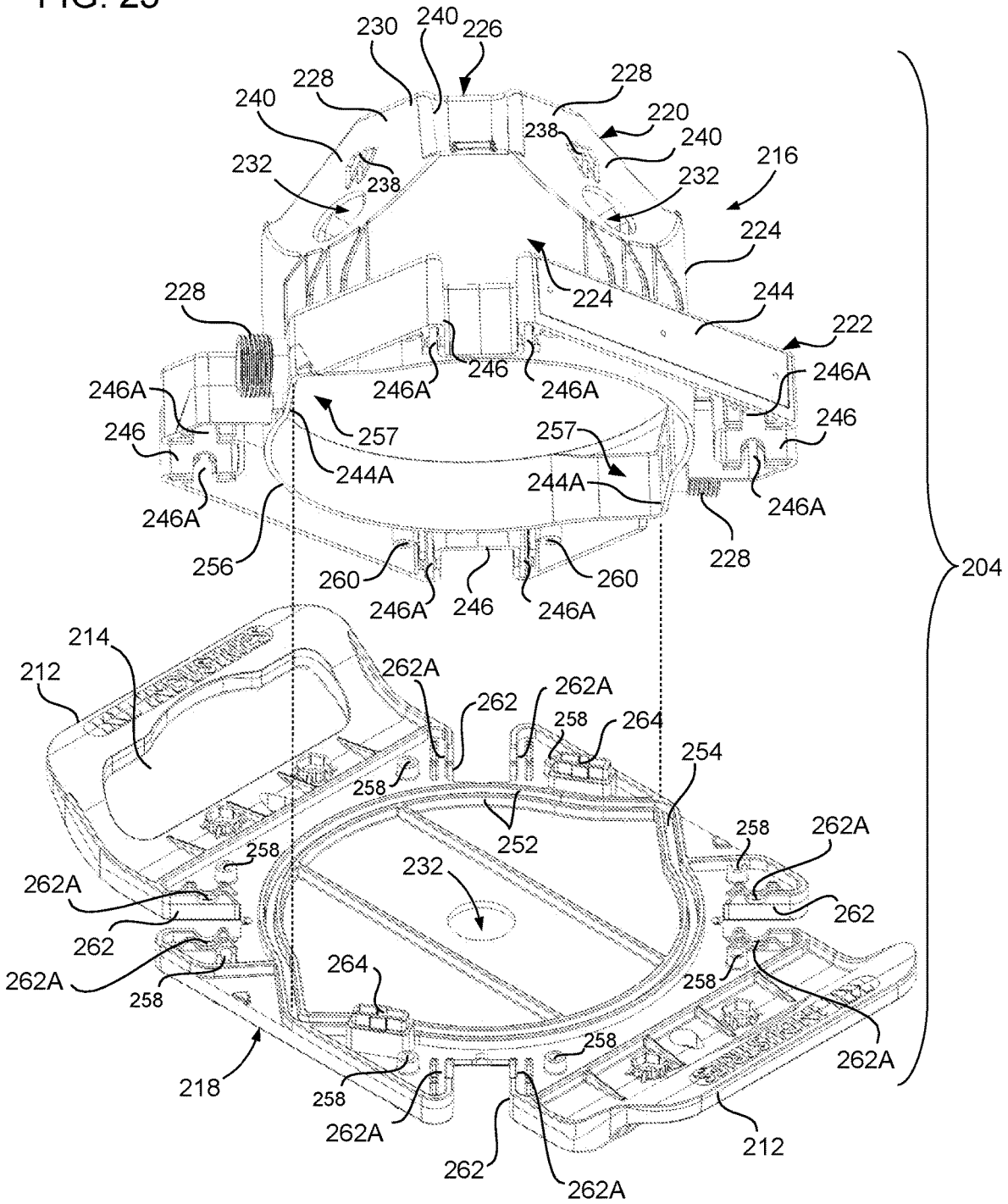
FIG. 25 is another exploded perspective view of the housing of FIG. 23.

As shown in both FIGS. 24 and 25, the removable cover 218 includes fastener-receiving bosses 258 formed with through-holes into which fasteners (not shown) extend to secure the cover to the enclosure 216. Corresponding fastener-receiving bosses formed with downwardly-facing blind bores (two of which are shown by reference number 260 in FIG. 25) are provided on the enclosure 216.

FIGS. 24 and 25 further illustrate that the removable cover 218 is formed with channel recesses 262 that are aligned with the channel recesses 246 of the enclosure 216. The edges of the channel recesses 262 and 246 are respectively formed with small circular cutouts 262A and 246A that providing a mounting location for pivot pins (not shown) that are used to pivotally attach the support members 206 to the enclosure housing 204.

A further feature of interest on the removable cover 218 is the provision of two slotted accessory attachment bosses 264 that may be used to attach buckles (not shown) that are secured to a light-assembly hanging strap, such as the strap 268 shown in FIG. 27 (described below). Other accessory attachment structures could also be provided at strategic locations on the multi-head light assembly housing 204.

Figure 26:
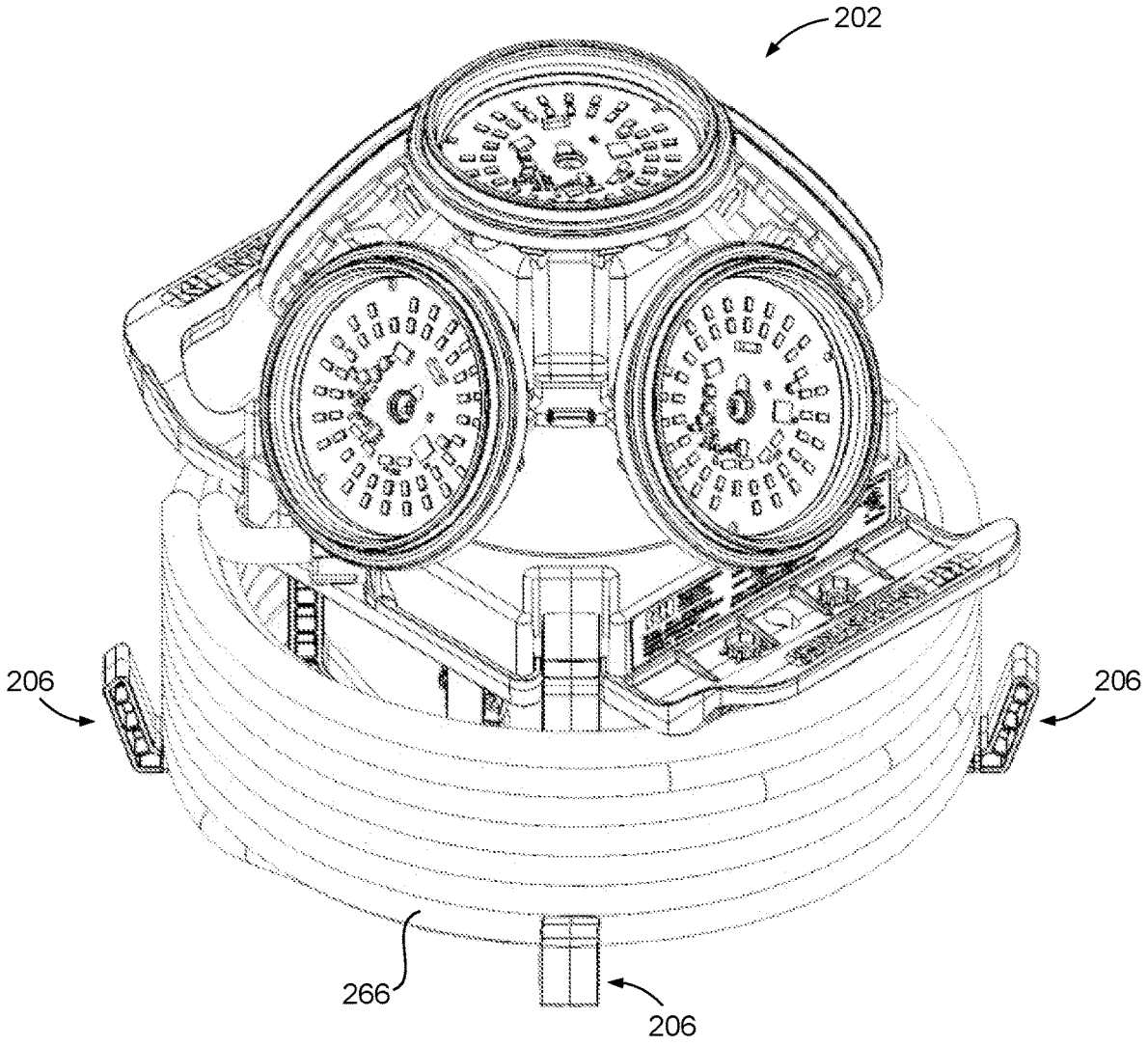
FIG. 26 is an upper perspective view of the multi-head unit of FIG. 18 in a storage configuration.

Turning now to FIG. 26, one of the advantages of the extended position of the support members 206 is that they can be used to wind a power cord 266 when the light assembly 202 is not in use. FIG. 26 thus illustrates one possible storage position of the light assembly 202. In this position, the cord 266 wraps around the outside of the support member legs 208, which extend generally vertically, and is supported by the support member feet 210, which extend generally horizontally outwardly from the feet before angling upwardly at their free ends. As best shown in FIGS. 21-22, the above-described support member structures are generally "J" shaped to facilitate efficient cord wrapping.

A further advantage of the wrapped-cord storage position of FIG. 26 is that several light assemblies 202 can be stacked vertically upon one another. Advantageously, in this stacking configuration the pocket recesses 240 (see FIG. 23) of one light assembly 202 will accept the heel end of the support member feet 210 of the light assembly above it.

Turning now to FIG. 27, an advantage of the retracted position of the support members 206 is that the light assembly 202 can be hung by a strap 268 in an inverted position to provide overhead lighting. As in the case of the light assembly 102, the strap 268 allows the light assembly 102 to be hung from an overhead support structure (not shown) so that the light assembly can illuminate a work area from above. As also noted above, the handles 212 of the light assembly 202 can be used to wall-mount the light assembly when its support members 202 are retracted.

Turning now to FIG. 28, a lighting string 270 is shown that makes use of a combination of four multi-head light assemblies, all of which are connected by sections of a power cord 108. Three of the light assemblies are multi-head feed-through units representing instances of the multi-head light assembly 202. A fourth one of the light assemblies is a modified multi-head light assembly 202A configured as a multi-head dead-end unit, as discussed above. Many other combinations of light assemblies could likewise be used to form modified lighting string arrangements. The lighting string 270 may be used to string the light assemblies 202/202A over a large work site. In FIG. 28, each light assembly 202 and 202A includes the mounting strap 268 of FIG. 27, so that the light assemblies may be hung to provide overhead lighting.

Figure 29:
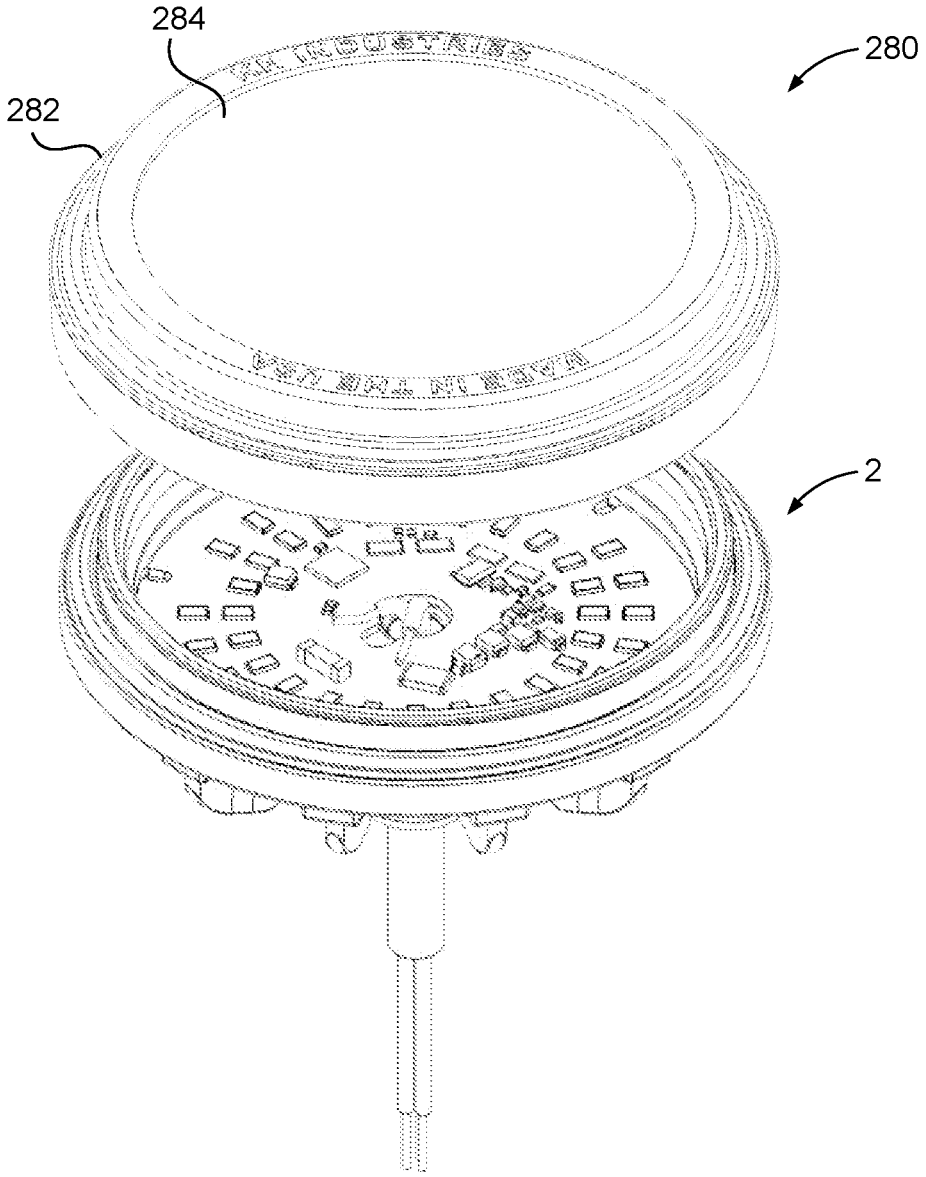
FIG. 29 is an exploded perspective view showing the light source module of FIG. 1 in combination with a disposable lens cover for use during certain operational conditions involving airborne debris.
Figure 30:
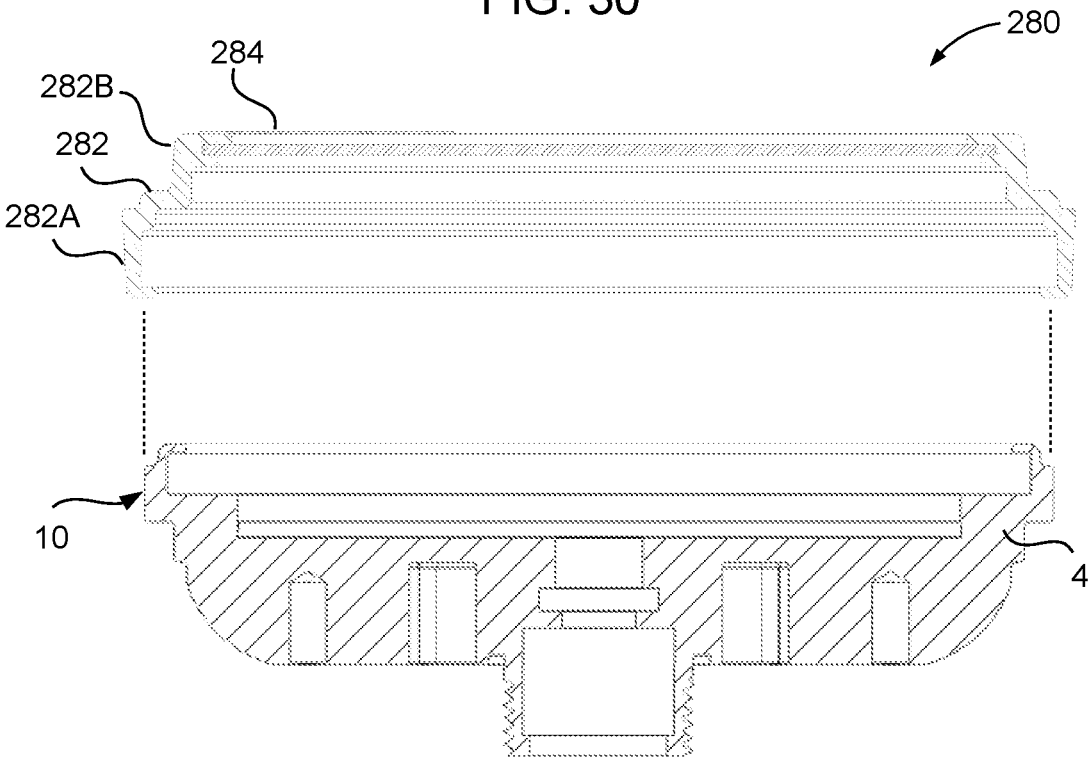
FIG. 30 is a cross-sectional centerline view showing the disposable lens cover of FIG. 29 positioned for mounting on a base carrier of the light module of FIG. 1.
Figure 31:
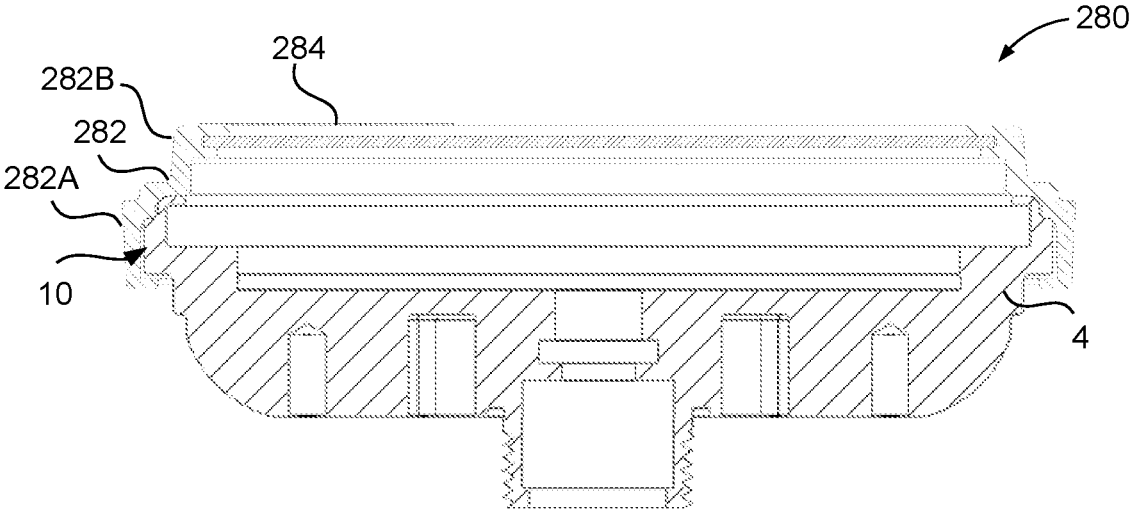
FIG. 31 is a cross-sectional centerline view showing the disposable lens cover mounted on a base carrier of the light module of FIG. 1.

Turning now to FIGS. 29 and 30, the light source module 2 of FIGS. 1-8 is combined with a disposable light-transmitting lens cover 280. The lens cover 280 can be removably mounted onto the light source module 2 in order to prevent airborne debris, such as paint spray, from permanently fouling the latter's protective lens 64. The lens cover 280 includes a substantially ring-shaped lens cover body 282 and a substantially disk-shaped light-transmitting lens 284. A suitable stretchable material, such as a thermoplastic elastomer (TPE) polymer, having electrically conductive properties, may be used to form the lens cover body 282, and if desired, the lens 284. The lens cover body 282 is a monolithic structure that includes a lower ring portion 282A and an upper ring portion 282B. The lower ring portion 282A of the lens cover body 282 has an interior wall profile that corresponds to the profile of the periphery 10 of the light source module's base carrier 4. As such, the lower ring portion 282A will snugly envelop and capture the base carrier periphery when mounted thereon. Due to its flexible nature, the lens cover body 282 can be stretched during mounting and unmounting. The upper ring portion 282B of the lens cover body 282 has an interior wall profile that is sized and configured (by providing a radially inwardly-facing ring slot) to engage a peripheral edge of the lens 284.

Accordingly, a portable hazardous location light source module has been disclosed, together with related portable modular hazardous location light assemblies that utilize one or more of the light source modules. Although various embodiments of the invention have been described, it should be apparent that many variations and alternative embodiments could be implemented in accordance with the invention. It is understood, therefore, that the invention is not to be in any way limited except in accordance with the spirit of the appended claims and their equivalents.

What is claimed is:

1. A hazardous location light source module designed for portable use, comprising:

a metal base carrier having a base carrier upper side, a base carrier lower side and a base carrier periphery;

a lighting-support surface on said base carrier upper side;

a light-emitting device board on said lighting-support surface, said light-emitting device board mounting one or more light-emitting devices;

a base-carrier mounting stem on said base carrier lower side;

said base-carrier mounting stem being configured for mounting said hazardous location light source module to a portable modular hazardous location light assembly;

a wiring port extending through said base carrier mounting stem to said base carrier upper side;

electrical wiring feeding through said wiring port and connected to supply electrical energy to said one or more light-emitting devices;

a main-lens support surface on said base carrier upper side;

a light-transmitting main lens on said main-lens support surface, said main lens having a main lens lower side facing toward said light-emitting devices and a main lens upper side facing away from said light-emitting devices;

said main lens comprising chemically strengthened glass and having a ratio of maximum dimension to maximum thickness of not less than approximately 40:1;

said main lens being permanently secured to said base carrier by virtue of said base carrier being a monolithic structure and said base carrier periphery being deformed into a main-lens retaining lip that folds over to capture said main lens on said main lens upper side; and a light-transmitting protective lens disposed above said main lens in spaced relationship therewith, said protective lens comprising an impact-resistant thermoplastic material and having a protective lens lower side facing toward said main lens and a protective lens upper side facing away from said main lens.

2. The hazardous location light source module of claim 1, wherein said base carrier is formed as a monolithic structure and said base carrier is formed as a monolithic structure and said main-lens retaining lip comprises a roller-formed lip.

3. The hazardous location light source module of claim 1, wherein said main-lens support surface comprises a main-lens support shoulder situated above and peripherally outboard from said lighting-support surface.

4. The hazardous location light source module of claim 1, wherein said protective lens is carried by a protective lens holder supported by said main lens.

5. The hazardous location light source module of claim 4, wherein said protective lens holder includes a first lens holder flange and a second lens holder flange.

6. The hazardous location light source module of claim 5, wherein said first lens holder flange is disposed between said main lens upper side and said base carrier peripheral lip.

7. The hazardous location light source module of claim 6, wherein said protective lens is permanently secured to said base carrier by virtue of said second lens holder flange being deformed into a protective lens-retaining lip that folds over to capture said protective lens on said protective lens upper side.

8. The hazardous location light source module of claim 1, further including a metallic grounding ferrule pressed into said wiring port in electrical contact with said base-carrier.

9. The hazardous location light source module of claim 1, further including a disposable light-transmitting lens cover having a lens cover body and a lens, said lens cover body having an inside surface profile that substantially corresponds to a profile of said base carrier periphery so as to envelop said base carrier periphery when mounted thereon.

10. The hazardous location light source module of claim 1 installed in a portable modular hazardous location light assembly, said assembly comprising:

one or more of said hazardous location light source modules;

a closed housing;

one or more mounting ports on said housing engaging said base-carrier mounting stem of said one or more hazardous location light source modules; and one or more power cord ports on said housing receiving one or more electrical power cords that connect electrically to said electrical wiring of said one or more hazardous location light source modules.

11. The assembly of claim 10, wherein said light assembly is a single-head unit having only one of said mounting port and mounting only a single one of said hazardous location light source modules.

12. The assembly of claim 11, wherein said single-head unit is a single-head dead-end unit having only a single one of said power cord ports receiving only a single one of said electrical power cords.

13. The assembly of claim 11, wherein said single-head unit is a single-head feed-through unit having two of said power cord ports receiving two of said electrical power cords.

14. The assembly of claim 11, wherein said single-head unit includes an apertured mounting element on said housing for mounting said single-head unit to an external structure.

15. The assembly of claim 11, wherein said single-head unit includes one or more straps on said housing enclosure for hanging said single-head unit to an external support structure.

16. The assembly of claim 11, wherein said single-head unit includes a handle on said housing for hand-carrying said single-head unit.

17. The assembly of claim 10, wherein said light assembly is a multi-head unit having multiple ones of said mounting port and mounting multiple ones of said hazardous location light source modules.

18. The assembly of claim 17, wherein said multi-head unit includes pivotable support members on said housing that can pivot between an extended position and a retracted position.

19. The assembly of claim 17, wherein said multi-head unit is configured as a multi-head feed-through unit having two of said power cord ports receiving two of said electrical power cords.

20. The assembly of claim 17, wherein said multi-head unit is configured as a multi-head dead-end unit having only a single one of said power cord ports receiving only a single one of said electrical power cords.

21. A hazardous location light source module designed for portable use, comprising:

a metal base carrier having a base carrier upper side, a base carrier lower side and a base carrier periphery;

a lighting-support surface on said base carrier upper side;

a light-emitting device board on said lighting-support surface, said light-emitting device board mounting one or more light-emitting devices;

a base-carrier mounting stem on said base carrier lower side;

said base-carrier mounting stem being configured for mounting said hazardous location light source module to a portable modular hazardous location light assembly;

a wiring port extending through said base carrier mounting stem to said base carrier upper side;

electrical wiring feeding through said wiring port and connected to supply electrical energy to said one or more light-emitting devices;

a main-lens support surface on said base carrier upper side;

a light-transmitting main lens on said main-lens support surface, said main lens being flat and having a main lens lower side facing toward said light-emitting devices and a main lens upper side facing away from said light-emitting devices;

said main-lens being permanently secured to said base carrier by virtue of said base carrier being a monolithic structure and said base carrier periphery being deformed into a main-lens retraining lip that folds over to capture said main lens on said main lens upper side;

a light-transmitting protective lens disposed above said main lens in spaced relationship therewith, said protective lens comprising an impact-resistant thermoplastic material and being flat and having a protective lens lower side parallel to and facing toward said main lens and a protective lens upper side facing away from said main lens; and said protective lens being carried by a protective lens holder supported by said main lens.

22. A portable modular hazardous location light assembly, said assembly comprising:

one or more of said hazardous location light source modules designed for portable use, each of said one or more hazardous location light source modules including:

a metal base carrier having a base carrier upper side, a base carrier lower side and a base carrier periphery;

a lighting-support surface on said base carrier upper side;

a light-emitting device board on said lighting-support surface, said light-emitting device board mounting one or more light-emitting devices;

a base-carrier mounting stem on said base carrier lower side;

said base-carrier mounting stem being configured for mounting said hazardous location light source module to a portable modular hazardous location light assembly;

a wiring port extending through said base carrier mounting stem to said base carrier upper side;

electrical wiring feeding through said wiring port and connected to supply electrical energy to said one or more light-emitting devices;

a main-lens support surface on said base carrier upper side;

a light-transmitting main lens on said main-lens support surface, said main lens having a main lens lower side facing toward said light-emitting devices and a main lens upper side facing away from said light-emitting devices;

said main lens comprising chemically strengthened glass and having a ratio of maximum dimension to maximum thickness of not less than approximately 40:1;

said main lens being permanently secured to said base carrier by virtue of said base carrier being a monolithic structure and said base carrier periphery being deformed into a main lens-retaining lip that folds over to capture said main lens on said main lens upper side; and a light-transmitting protective lens disposed above said main lens in spaced relationship therewith, said protective lens comprising an impact-resistant thermoplastic material and having a protective lens lower side facing toward said main lens and a protective lens upper side facing away from said main lens;

said portable modular hazardous location light assembly further including:

a closed housing;

one or more mounting ports on said housing engaging said base-carrier mounting stem of said one or more hazardous location light source module;

one or more power cord ports on said housing receiving one or more electrical power cords that connect electrically to said electrical wiring of said one or more hazardous location light source modules; and said light assembly being configured as one of a (1) single-head unit having one of said hazardous location light source module, or (2) a multi-head unit having multiple ones of said hazardous location light source module.

* * * * *